US010683179B2

(12) United States Patent
Yazawa et al.

(10) Patent No.: US 10,683,179 B2
(45) Date of Patent: Jun. 16, 2020

(54) SHEET FEEDING APPARATUS AND IMAGE FORMING APPARATUS HAVING THE SAME

(71) Applicants: Hiroshi Yazawa, Yamanashi (JP); Kei Horiuchi, Yamanashi-ken (JP)

(72) Inventors: Hiroshi Yazawa, Yamanashi (JP); Kei Horiuchi, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/922,344

(22) Filed: Mar. 15, 2018

(65) Prior Publication Data

US 2018/0267453 A1 Sep. 20, 2018

(30) Foreign Application Priority Data

Mar. 17, 2017 (JP) ..... 2017-053025

(51) Int. Cl.
*B65H 1/14* (2006.01)
*G03G 15/00* (2006.01)
(Continued)

(52) U.S. Cl.
CPC ..... *B65H 1/14* (2013.01); *B65H 1/025* (2013.01); *B65H 1/04* (2013.01); *B65H 1/266* (2013.01); *B65H 7/04* (2013.01); *B65H 7/20* (2013.01); *G03G 15/6502* (2013.01); *G03G 15/6555* (2013.01); *B65H 2403/544* (2013.01); *B65H 2405/10* (2013.01); *B65H 2405/11164* (2013.01); *B65H 2405/15* (2013.01); *B65H 2405/313* (2013.01); *B65H 2511/10* (2013.01); *B65H 2511/11* (2013.01);
(Continued)

(58) Field of Classification Search
CPC ... B65H 1/04; B65H 1/14; B65H 1/18; B65H 1/266; B65H 7/00; B65H 7/02; B65H 7/04; B65H 7/14; B65H 7/20; B65H 2405/10; B65H 2405/11164; B65H 2405/15; B65H 2405/31; B65H 2405/312; B65H 2405/32; B65H 2511/10; B65H 2511/11; B65H 2511/20; B65H 2511/414
See application file for complete search history.

(56) References Cited

U.S. PATENT DOCUMENTS

2014/0284871 A1* 9/2014 Nishioka ..... B65H 7/20 271/110
2017/0203930 A1* 7/2017 Yamauchi ..... G03G 15/6511
2018/0111771 A1* 4/2018 Igari ..... B65H 3/06

FOREIGN PATENT DOCUMENTS

JP S63-272724 A 4/1987
JP H07-033265 A 2/1995
(Continued)

*Primary Examiner* — Prasad V Gokhale
(74) *Attorney, Agent, or Firm* — Manabu Kanesaka

(57) ABSTRACT

A sheet feeding apparatus includes a sheet tray configured to hold sheets, a sheet feeding unit configured to feed sheets from the sheet tray, and a lift unit configured to move the sheet tray up and down. When the type of sheets to be held on the sheet tray is to be changed to another type, the lift unit moves the sheet tray up or down to a sheet holding position set for sheets of the other type. Thus, the position where the sheet tray can hold sheets is changed in accordance with the material or size of the sheets. The largest number, in which sheets can be mounted on the sheet tray, can thereby be changed.

19 Claims, 12 Drawing Sheets

(51) Int. Cl.

| | |
|---|---|
| ***B65H 1/02*** | (2006.01) |
| ***B65H 1/26*** | (2006.01) |
| ***B65H 7/04*** | (2006.01) |
| ***B65H 1/04*** | (2006.01) |
| ***B65H 7/20*** | (2006.01) |

(52) U.S. Cl.
CPC .... *B65H 2511/20* (2013.01); *B65H 2511/414* (2013.01); *B65H 2515/112* (2013.01); *B65H 2801/06* (2013.01); *G03G 2215/00945* (2013.01)

(56) References Cited

FOREIGN PATENT DOCUMENTS

| | | | |
|---|---|---|---|
| JP | H08-091593 | A | 4/1996 |
| JP | 2002-338069 | A | 11/2002 |
| JP | 2003-063719 | A | 3/2003 |

* cited by examiner

SHEET FEEDING APPARATUS AND IMAGE FORMING APPARATUS HAVING THE SAME

BACKGROUND OF THE INVENTION

1. Field of the Invention

The present invention relates to a sheet feeding apparatus configured to feed sheets to image forming apparatuses, and to an image forming apparatus having the sheet feeding apparatus.

2. Description of Related Arts

Sheet feeding apparatuses have been known, which feed sheets to image forming section of image forming apparatuses such as copiers and printers. One type of a sheet feeding apparatus has a sheet cassette that can hold about 100 sheets. Another type of a sheet feeding apparatus has a storage box that can hold thousands of sheets. The sheet feeding apparatus having such a storage box further comprises a sheet tray provided in the storage box and configured to hold sheets, a lift mechanism configured to lift and lower the sheet tray, a drive motor configured to dive the lift mechanism, a feeding roller configured to contact the upper surface of the uppermost sheet held in the sheet tray and to feed the uppermost sheet, and a separating mechanism configured to separate each sheet from the other sheets and transport the same to an image forming apparatus. In the sheet feeding apparatus of this type, if sheets are mounted on the sheet tray, the drive motor is driven, moving the sheet tray upwards. When the upper surface of the uppermost sheet contacts the feeding roller, the sheet tray is stopped, not moving up further. Thereafter, in response to a sheet-feeding signal, the feeding roller is driven, feeding the sheet from the sheet tray. Then, the separating mechanism separates the sheet from the other sheets, whereby the sheet is supplied to an image forming apparatus.

It is demanded that the sheet feeding apparatus should feed not only the regular-size sheets such as A6, B5, A4, letter, B4, A3 and legal sheets, but also special sheets such as long sheets (sheets other than regular-size sheets) and OHP sheets. To meet this demand, a large-capacity sheet holding apparatus has been proposed, which has one storage section and removable partitions arranged in the storage section, and a plurality of sheet trays arranged among the removable partitions. If some partitions are removed, the sheet holding apparatus can hold sheets larger than one tray. A sheet feeding apparatus of another type has been proposed, in which each tray contains an auxiliary tray, sheets of ordinary size are mounted on the tray, and the auxiliary tray is pulled from the tray to hold sheets of any larger size, thus supporting that part of each sheet which extends from the tray.

The sheets most frequently used in image forming apparatuses are small-size sheets such as A4 sheets, letter sheets and sheets smaller than letter sheets. B4 sheets, A3 sheets and legal sheets, all larger than A4 and letter sheets, and special sheets, e.g. long sheets and OHP sheets, are less frequently used than the small-size sheets.

The larger the size of the sheets fed by the sheet feeding apparatus, the greater will be the maximum weight that may be applied on the sheet tray. The weight applied on the sheet tray will increase if the sheet feeding apparatus feeds sheets such as OHP sheets that are made of material different from that of ordinary sheets. Thus, the more the maximum weight applied on the sheet tray increases, the more strong the lift mechanism should be made, and the drive motor for driving the lift mechanism should have a larger torque. The configuration of the sheet feeding apparatus and the components thereof must be designed and used on the basis of the heaviest sheet that the apparatus can feed. Hence, the drive motor must be large enough to feed large sheets and heavy special sheets, too, which the sheet feeding apparatus feeds at low frequency. Consequently, the sheet feeding apparatus consumes more electric power. Further, the lift mechanism must be heavier and more complex in structure. As a result, the sheet feeding apparatus will be massive and heavy, and its manufacturing cost will increase.

SUMMARY OF THE INVENTION

A sheet feeding apparatus according to this invention comprises a sheet tray configured to hold sheets; a sheet feeding unit configured to feed sheets from the sheet tray; and a lift unit configured to move the sheet tray up and down. When the type of sheets to be held on the sheet tray is changed to another type, the lift unit therefore moves the sheet tray up or down to a sheet holding position set for sheets of the other type. The sheet holding position can therefore be changed in accordance with the material or size of the sheets, and the largest number of sheets able to be held on the sheet tray can be changed.

DETAILED DESCRIPTION OF THE PREFERRED EMBODIMENTS

Figure 1:
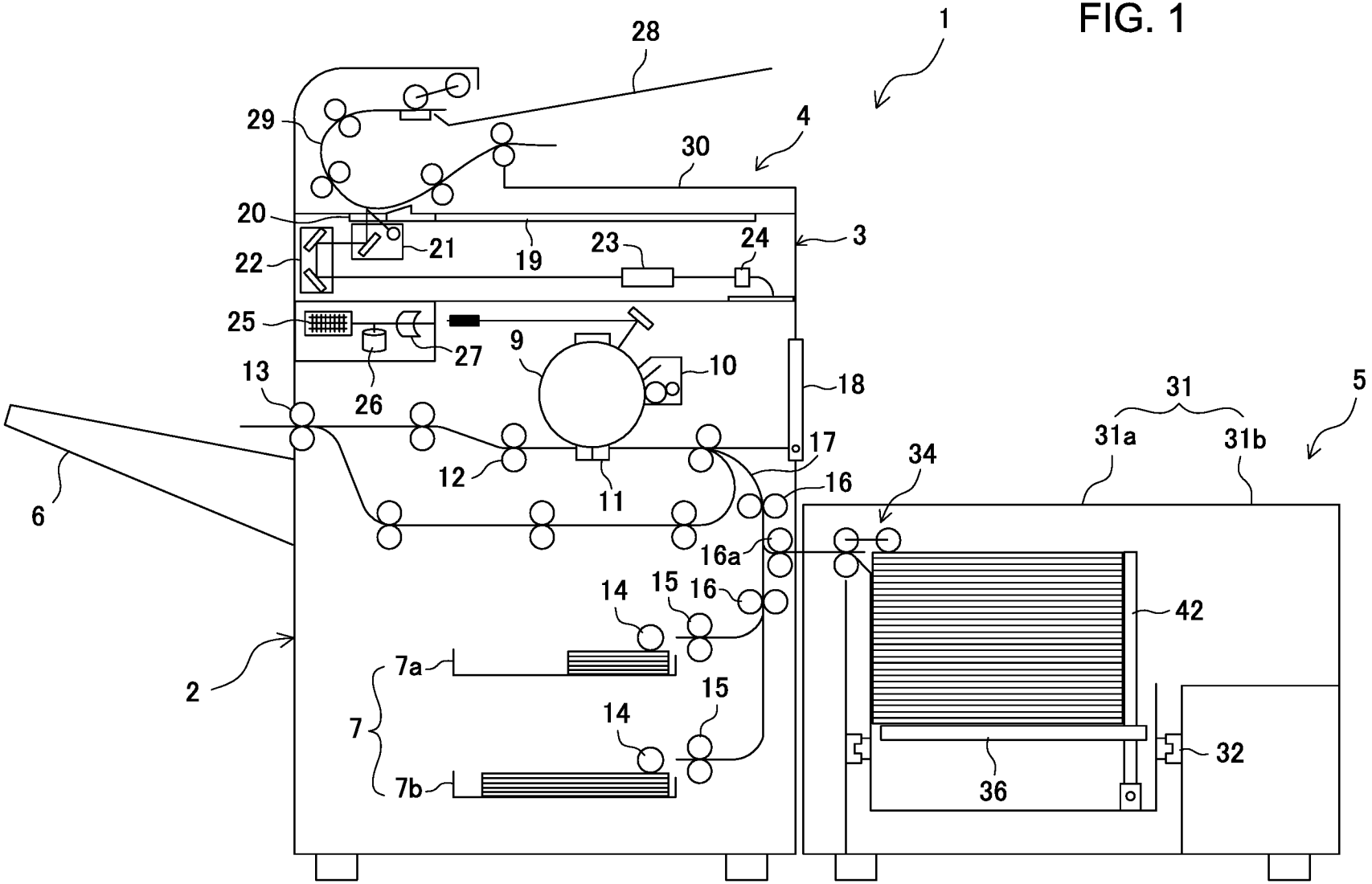
FIG. 1 is a diagram showing the overall configuration of an image forming system having a sheet feeding apparatus according to a first embodiment of this invention.

The embodiments of this invention will be described with reference to the accompanying drawings.

First, the overall configuration of an image forming system 1 will be described with reference to FIG. 1. The image forming system 1 comprises an image forming apparatus 2, an original reading apparatus 3, an original feeding apparatus 4, a sheet feeding apparatus 5, and a sheet accumulating apparatus 6. The image forming apparatus 2 has sheet cassettes 7, each capable of holding about 100 sheets. (The embodiment shown in FIG. 1 has two sheet cassettes 7*a* and 7*b*.) Based on the image data read from an original sheet by the original reading apparatus 3, an image is formed on the sheet fed from the sheet cassette 7*a*, sheet cassette 7*b* or sheet feeding apparatus 5. The sheet, on which an image formed, is supplied to the sheet accumulating apparatus 6 and stored therein. The original sheet can be supplied to the original reading apparatus 3 by the original feeding apparatus 4. The sheets on which images are formed in the image forming system 1 include not only ordinary sheets, e.g., small-size sheets such as A6, B5 and A4 sheets and large sheets such as B4 and A3 sheets, but also sheets longer than regular size, and special sheets such as OHP sheets, tracing paper sheets and coated sheets.

The image forming apparatus 2 is, for example, a copier, a printer or a facsimile apparatus, and is installed on the floor. The image forming apparatus 2 has any image forming mechanism, provided that it can form images on sheets. The image forming apparatus 2 shown in FIG. 1 has an electrostatic image-forming mechanism. However, the image-forming mechanism of the image forming apparatus 2 is not limited to an electrostatic one, and may be an ink-jet image forming mechanism, an offset image forming mechanism or the like.

The image forming apparatus 2 shown in FIG. 1 comprises a light-emitting device (e.g., laser head) 8, a photosensitive drum 9, a developing device 10, a transfer charger 11, and fixing rollers 12. The light-emitting device 8 applies a light beam to the photosensitive drum 9, forming a latent image (still image) on the surface of the photosensitive drum 9. The developing device 10 applies toner to the latent image, forming a toner image. The toner image is transferred by the transfer charger 11 from the photosensitive drum 9 to the sheet supplied from the sheet cassette 7*a*, 7*b*, or sheet feeding apparatus 5. The sheet having the toner image is fed to the fixing rollers 12 located on the downstream side of the transfer charger 11. The fixing rollers 12 heat the toner, fixing the image. Then, the sheet is ejected by a pair of sheet-ejecting rollers 13 into the sheet accumulating apparatus 6.

Each of the sheet cassettes 7*a* and 7*b* has a feeding roller 14 and a pair of separating rollers 15. The feeding roller 14 contacts the upper surface of the uppermost sheet held in the cassette, and feeds the uppermost sheet from the cassette. The separating rollers 15 separate the sheet from the other sheets held in the cassette. The sheet fed by the feeding roller 14 and separated by the separating rollers 15 is transported by pairs of transport rollers 16. The sheet is then sent to the transfer charger 11 through a transport path 17. Meanwhile, the sheet fed from the sheet feeding apparatus 5 is transported by a pair of transport rollers 16*a* to the transport path 17. The sheet is then similarly transported by a pair of transport rollers 16 to the transfer charger 11 through the transport path 17.

At one side of the image forming apparatus 2, a manual-feeding tray 18 is provided. The manual-feeding tray 18 is usually closed, extending along the side of the image forming apparatus 2. To feed a sheet manually, the operator may open the manual-feeding tray 18 at the side of the image forming apparatus 2. Then, the sheet mounted on the manual-feeding tray 18 can be transported into the transport path 17.

On the top of the original reading apparatus 3, a first platen 19 and a second platen 20, both made of transparent glass, are juxtaposed in the horizontal direction. The first platen 19 is used to read an original which is set by hand, and is large enough to hold the largest original that the image forming system 1 can copy. The second platen 20 is used to read any original transported from the original feeding apparatus 4 and moving at a prescribed speed.

The original reading apparatus 3 incorporates a first reading carriage 21, a second reading carriage 22, and an optoelectronic transducing unit having a focusing lens 23 and an optoelectronic transducer 24. The first reading carriage 21 and the second reading carriage 22 are driven by a carriage motor (not shown), and are moved below the first platen 19, back and forth in the sub-scanning direction. On the first reading carriage 21, a lamp and a mirror are mounted. The lamp applies light to the original, and the mirror reflects the light reflected from the original. The second reading carriage 22 has two mirrors, which guide the light from the mirror mounted on the first reading carriage 21 to the focusing lens 23 and the optoelectronic transducer 24, respectively. To read the original mounted on the first platen 19, light is applied from the first reading carriage 21 to the image printed on the original, while the first and second reading carriages 21 and 22 are being moved, and the light reflected from the original is guided to the optoelectronic transducer 24 via the first and second reading carriages 21 and 22 and is then converted into an electric signal. Image data is thereby generated from the original.

The image forming apparatus 2 comprises a control panel 25, an image-data storing unit 26, and a buffer memory 27. The control panel 25 may be operated to set image-forming conditions such as the sheet type, color printing, monochromic printing, number of prints, one-side printing, double-side printing, image enlarging, and image reducing. The image-data storing unit 26 may store image data that the optoelectronic transducer 24 has generated from the data read by the original reading apparatus 3 as described above. The image-data storing unit 26 can store the image data transferred through, for example, the network. The image data stored in the image-data storing unit 26 is transferred to the buffer memory 27, and is sequentially transmitted from the buffer memory 27 to the light-emitting device 8.

The original feeding apparatus 4 comprises a sheet feeding tray 28, a sheet transporting mechanism 29, and an ejected-sheet tray 30. The sheet transporting mechanism 29 transports sheets, one by one, from the sheet feeding tray 28 over the second platen 20 to finally eject each sheet to the ejected-sheet tray 30. To read the original transported from the original feeding apparatus 4 over the second platen 20, the first and second reading carriages 21 and 22 are stopped below the second platen 20, and image data is generated from the original being transported over the second platen 20.

Figure 2:
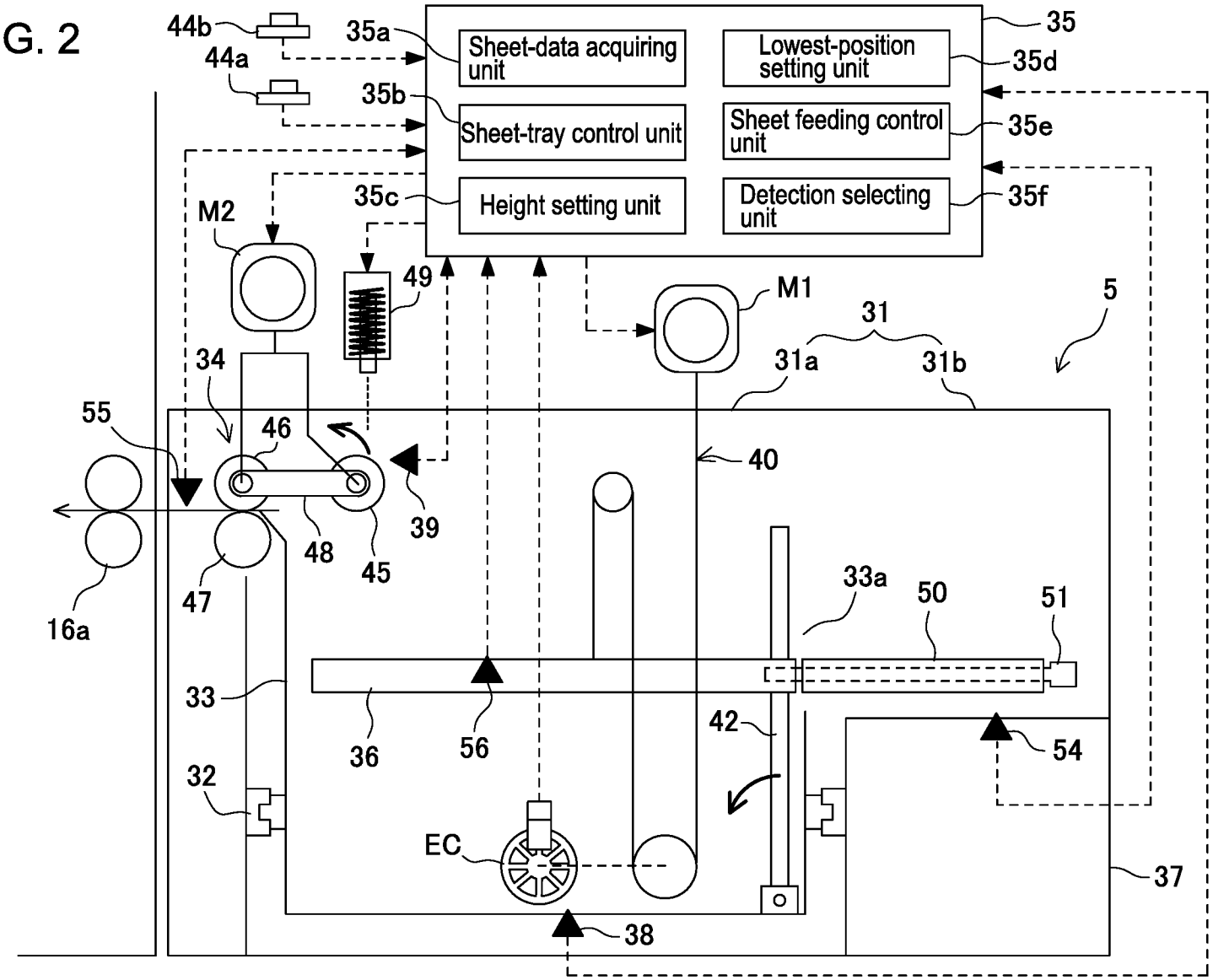
FIG. 2 is a diagram showing the inner configuration of the sheet feeding apparatus according to the first embodiment of this invention.

The sheet feeding apparatus 5 according to the first embodiment will be described in detail, with reference to FIG. 2 and FIG. 3.

The sheet feeding apparatus 5 comprises a housing 31, a pulling mechanism 32, a storage box 33, a sheet separating/feeding mechanism 34, and a control device 35. The housing 31 is composed of a main part 31*a* located near the image forming apparatus 2, and an extending part 31*b* extending from the upper part of the main part 31*a*, away from the image forming apparatus 2. The storage box 33 is provided in the housing 31 and can be pulled out by the pulling mechanism 32 from the housing 31 in the sheet-feeding direction in which sheets are fed from the sheet feeding apparatus 5 to the image forming apparatus 2. The sheet separating/feeding mechanism 34 is configured to separate one sheet from others in the storage box 33 and then transport the sheet toward the image forming apparatus 2. The control device 35 controls the sheet feeding apparatus 5. In the storage box 33, a sheet tray 36 is provided, able to move up and down. Below the extending part 31*b*, a frame member 37 is provided and supports the extending part 31*b*. The sheet tray 36 is a plate, and can hold sheets of the first type (hereinafter referred to as "ordinary-size sheets"). On the bottom of the storage box 33, a tray lowest-position detector 38 is provided to detect that the sheet tray 36 has reached its lowest position. When the tray lowest-position detector 38 detects the sheet tray 36, the sheet tray 36 is stopped, not moving down further. At the top of the storage box 33, an upper-surface detector 39 is arranged to detect the upper surface of the uppermost sheet mounted on the sheet tray 36. Therefore, the sheet tray 36 can be moved by a lift mechanism 40 in accordance with the number of sheets mounted on the sheet tray 36.

The extending part 31*b* of the housing 31, which extends from the top of the main part 31*a* and away from the image forming apparatus 2, can hold the rear end (as viewed in the sheet-feeding direction) of any sheet extending from the sheet tray 36, as long as the upper surface (sheet-holding surface) of the sheet tray 36 remains at a position higher than the bottom of the extending part 31*b* of the housing 31. Hence, the sheet feeding apparatus 5 can store sheets of the second type (hereinafter referred to as "long sheets") that are larger than the ordinary-size sheets, not fit in the sheet tray 36, and can feed long sheets to the image forming apparatus 2.

In the first embodiment shown in the drawings, the lift mechanism 40 is composed of wires (only one shown in FIG. 2, for simplicity), take-up pulleys, intermediate pulleys, and a lift motor M1. The wires are secured to the support parts of the sheet tray 36. The take-up pulleys take up the wires, respectively. The wires extending between the take-up pulleys and the support parts of the sheet tray 36 are wrapped around the intermediate pulleys, respectively. The lift motor M1 rotates the take-up pulleys. The lift mechanism 40 is not limited to this type, nevertheless, if it can keep moving the sheet tray 36 in a substantially horizontal position.

The storage box 33 has an opening in the top. When the storage box 33 is pulled out from the housing 31, sheets can be mounted through the opening onto the storage box 33 and mounted on the sheet tray 36 provided in the storage box 33. The storage box 33 has a slit 33*a* cut in the upper part of its side wall that faces the extending part 31*b*. The slit 33*a* allows the space (hereinafter referred to as "tray storage space") for accommodating the sheet tray 36 inside the storage box 33 to communicate with the extending part 31*b* of the housing 31. The slit 33*a* is broad enough to allow a long sheet to project from the storage box 33 into the extending part 31*b*.

Further, sheet-side adjusting members 41*a* and 41*b* and a sheet rear-end adjusting member 42 are provided in the tray storage space. The sheet-side adjusting members 41*a* and 41*b* are designed to contact the sides of each sheet mounted on the sheet tray 36 in the widthwise direction of the sheet (i.e., direction perpendicular to the sheet-feeding direction). The rear-end adjusting member 42 is positioned at the rear end (i.e., end far from the image forming apparatus 2 in the sheet-feeding direction) of any ordinary-size sheet mounted on the sheet tray 36. The sheet-side adjusting members 41*a* and 41*b* adjust the positions of the lateral edges of any sheet that tilts to the direction of feeding sheets from the sheet tray 36. The sheet rear-end adjusting member 42 adjusts the position of the rear end of any ordinary-size sheet mounted on the sheet tray 36. In the first embodiment, the sheet-side adjusting members 41*a* and 41*b* stand on the bottom of the storage box 33 and can act in unison with, for example, racks and pinions, thereby to slide in the widthwise direction of the sheets. Further, the sheet-side adjusting members 41*a* and 41*b* extend passing through windows 36*a* and 36*b* made in the sheet tray 36, to allow a sheet to move in its widthwise direction. The sheet rear-end adjusting member 42 stand on the bottom of the storage box 33 in such a way as to slide in the sheet-feeding direction, and extends passing through a window 36*c* made in the sheet tray 36, to allow a sheet to move in the sheet-feeding direction. This configuration allows the sheet-side adjusting members 41*a* and 41*b* and the rear-end adjusting member 42 to move on the bottom of the storage box 33, thereby to adjust the positions of the sides of any sheet and the rear end thereof (as viewed in the sheet-feeding direction) on the sheet tray 36, in accordance with the size of the sheet.

Figure 4A:
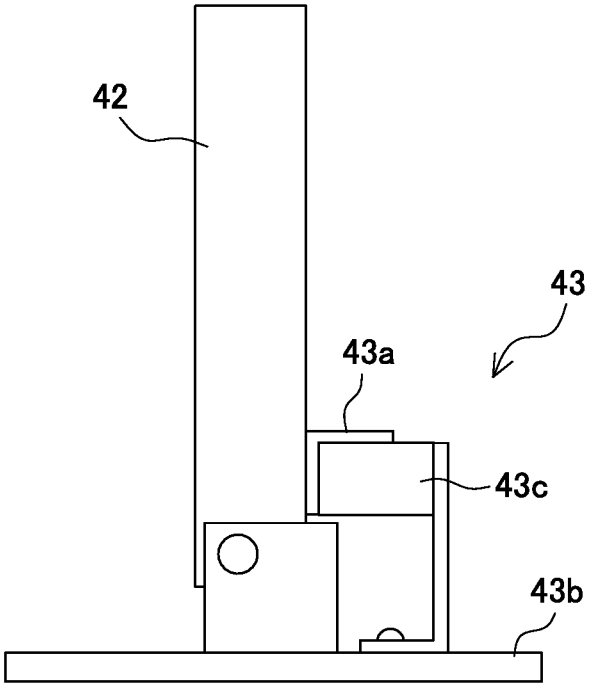
FIG. 4A is a diagram showing the rear-end controlling member of the sheet feeding apparatus according to the first embodiment of this invention, illustrating the state the rear-end controlling member assumes while the apparatus holds sheets of ordinary size.
Figure 4B:
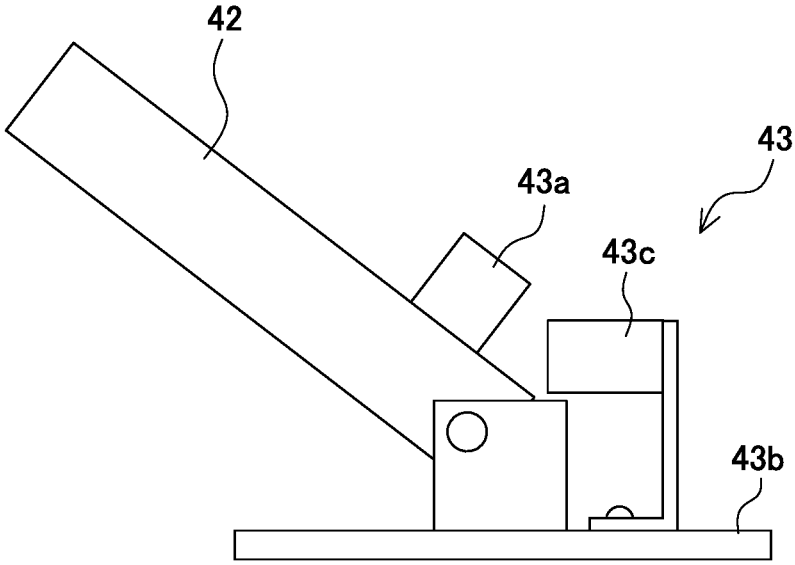
FIG. 4B is a diagram showing the rear-end controlling member of the sheet feeding apparatus according to the first embodiment of this invention, illustrating the state the rear-end controlling member assumes while the apparatus holds long sheets.

As shown in detail in FIGS. 4A and 4B, the sheet rear-end adjusting member 42 is configured to rotate around the axle provided at its lower part, to the downstream in the sheet-feeding direction (namely, into the sheet storage space of the sheet tray). This prevents the sheet rear-end adjusting member 42 from hindering the mounting long sheets onto the sheet tray 36. In the first embodiment shown, the extending part 31*b* is provided, only above the top of the main part 31*a*, and the sheet tray 36 should be positioned above the bottom of the extending part 31*b* of the housing 31, in order to hold long sheets. Hence, if the sheet rear-end adjusting member 42 lies below the bottom of the extending part 31*b* when the sheet rear-end adjusting member 42 is rotated down toward the sheet storage space, the sheet rear-end adjusting member 42 does not prevent long sheets from being mounted onto the sheet tray 36, even if the sheet rear-end adjusting member 42 is rotated by 90° only, not completely rotated down. In the first embodiment, the sheet rear-end adjusting member 42 is rotated by only 60° from the standing position illustrated in FIG. 4A to the tilting position illustrated in FIG. 4B. The upper end of the sheet rear-end adjusting member 42 so rotated is positioned below the lowest position the sheet tray 36 takes when it holds long sheets, and near the lowest position of the sheet tray 36. The distance the sheet rear-end adjusting member 42 is moved to hold long sheets can therefore be minimized to enable the sheet rear-end adjusting member 42 to stand up and rotate down.

The window 36*c* of the sheet tray 36 is large enough to make the sheet rear-end adjusting member 42 rotate from the standing position to the rotated-down position, and from the rotated-down position to the rotated-down position, no matter whichever height the sheet tray 36 is positioned.

In the first embodiment shown in the drawings, a mode-change detecting mechanism 43 detects the position of the sheet rear-end adjusting member 42 rotated, and the control device 35 switches the operating mode between an ordinary-sheet feeding mode of storing ordinary-size in the sheet feeding apparatus 5 and a long-sheet feeding mode of storing long sheets. As shown in FIG. 4A and FIG. 4B, the mode-change detecting mechanism 43 for detecting the position of the sheet rear-end adjusting member 42 rotated comprises a detecting flag 43*a*, a base member 43*b*, and a mode-change detector 43*c*. The detecting flag 43*a* is secured to the rear-end adjusting member 42. The base member 43*b* supports the sheet rear-end adjusting member 42, enabling the same to slide on the bottom of the storage box 33. The mode-change detector 43*c* is provided on the base member 43*b*. The mode-change detector 43*c* may be positioned to detect the detecting flag 43*a* while the sheet rear-end adjusting member 42 remains in the standing position, and not to detect the detecting flag 43*a* while the sheet rear-end adjusting member remains rotated down. The switching between the ordinary-sheet feeding mode and the long-sheet feeding mode can, of course, be detected by any other mechanism. For example, it can be detected from an operation button 44*a* provided on, for example, an outer surface of the sheet feeding apparatus 5, or from the control panel 25 of the image forming apparatus 2.

The sheet separating/feeding mechanism 34 includes a sheet feeding roller 45 and a sheet-separating/transporting unit. The sheet feeding roller 45 contacts the upper surface of the uppermost sheet held in the sheet tray 36 and then feeds out the uppermost sheet. The sheet separating/feeding unit transports the fed-out sheets one by one to the image forming apparatus 2. The sheet-separating/transporting unit comprises a sheet supplying roller 46 and a sheet separating roller 47. The sheet separating roller 47 is pressed to the sheet supplying roller 46 and prevents the second sheet et seq. from being fed from the sheet tray 36.

The sheet supplying roller 46 is driven by gears driven by a sheet feeding motor M2, via gears (not shown) or a timing belt (not shown). As the sheet supplying roller 46 is driven by the sheet feeding motor M2, it feeds sheets one after another. The sheet feeding roller 45 is supported by a bracket 48 mounted rotable on the shaft of the sheet supplying roller 46 and can therefore rotate. The sheet feeding roller 45 rotates when it receives, via a plurality of gears, the rotation of the shaft of the sheet supplying roller 46 driven by the sheet feeding motor M2. Further, the sheet feeding roller 45 can be rotated around the shaft of the sheet supplying roller 46, between an operating position where it contacts the upper surface of the sheet and a waiting position where it stays far from the upper surface of the sheet. In this embodiment, a solenoid 49 is turned on and off repeatedly, rotating the bracket 48 around the shaft of the sheet supplying roller 46. The sheet feeding roller 45 is thereby moved between the operating position and the waiting position.

A torque limiter (not shown) is mounted on the shaft of the sheet separating roller 47. Therefore, if two or more sheets overlap while being nipped by the sheet supplying roller 46 and the sheet separating roller 47, the sheet separating roller 47 is stopped, not feeding the second sheet and the following sheets. That is, if two or more sheets enter the nip between the sheet supplying roller 46 and the sheet separating roller 47, the drive force of the sheet supplying roller 46 is transmitted to the uppermost sheet and the sheet separating roller 47 is stopped rotating. As a result, the uppermost sheet and the second uppermost sheet slip on each other, and the uppermost sheet is separated from the second uppermost sheet and the sheets following the second uppermost sheet. The sheet separating roller 47 may, of course, be replaced by a separating pad or the like.

The extending part 31*b* incorporates an extension tray 50 designed to support that part of any long sheet, which is rear in the sheet-feeding direction, extending from the sheet tray 36. The extension tray 50 is coupled to the sheet tray 36 in order to feed long sheets into the sheet feeding apparatus 5. Once coupled to the sheet tray 36, the extension tray 50 move up and down, together with the sheet tray 36. In this embodiment, that side of the sheet tray 36, which is upstream in the direction of feeding sheets (right-hand side surface in FIG. 3), has a plurality of screw holes, the extension tray 50 has a plurality of through holes extending in the sheet-feeding direction and aligned with the screw holes, respectively. Further, connecting shafts 51 each having a male screw on the distal end are inserted in the through holes of the extension tray 50, respectively, and are set in screw engagement with the screw holes made in one side of the sheet tray 36. The sheet tray 36 and the extension tray 50 are thereby coupled to each other.

The front wall of the extending part 31*b* (namely, the wall forward as viewed in FIG. 2) is formed integral with the front of the storage box 33. Therefore, the extension tray 50 can be pulled from the extending part 31*b* as the storage box 33 is drawn out. Hence, even if the extension tray 50 is coupled to the sheet tray 36, it can be pulled from the extending part 31*b* as the storage box 33 is drawn out.

The extending part 31*b* incorporates long-sheet side adjusting members 52*a* and 52*b* and a long-sheet rear-end adjusting member 53. The adjusting members 52*a* and 52*b* adjust the positions the sides of any long sheet takes in the sheet widthwise direction. The long-sheet rear-end adjusting member 53 adjusts the position of the rear end of any long sheet takes in the direction of feeding the long sheet. In the embodiment illustrated, the long-sheet side adjusting members 52*a* and 52*b* are secured on the extension tray 50 and can slide together in the widthwise direction of the long sheet by means of, for example, a lack-pinion unit. The long-sheet rear-end adjusting member 53 is secured to the extension tray 50 and can slide in the direction of feeding the long sheets.

In the lowest part of the extending part 31*b*, an extension-tray lowest-position detector 54 is provided to detect whether the extension tray 50 moving up and down together with the sheet tray 36 has reached its lowest position in the extending part 31*b*. If the extension-tray lowest-position detector 54 detects the extension tray 50, the control device 35 stops the sheet tray 36 moving down. If the extension-tray lowest-position detector 54 detects the extension tray 50 while ordinary-size sheets are being stored into the storage box 33 of the sheet feeding apparatus 5, an alarm is generated, informing that the operator has forgotten to disconnect the extension tray 50 from the sheet tray 36.

The control device 35 includes a sheet-data acquiring unit 35*a*, a sheet-tray control unit 35*b*, a height setting unit 35*c*, a lowest-position setting unit 35*d*, a sheet feeding control unit 35*e*, and a detection selecting unit 35*f*. The sheet-data acquiring unit 35*a* acquires the data representing the type of the sheets mounted on the sheet tray 36. The sheet-tray control unit 35*b* controls the up-down motion of the sheet tray 36. The sheet feeding control unit 35*e* controls the sheet separating/feeding mechanism 34. The height setting unit 35*c* sets, based on the sheet type represented by the sheet data acquired by the sheet-data acquiring unit 35*a*, the height (hereinafter referred to as "sheet-mounting preparation position") at which the sheet tray 36 should be stopped to receive new sheets. The lowest-position setting unit 35*d* sets the lowest position that the sheet tray 36 should take, based on the sheet type represented by the sheet data acquired by the sheet-data acquiring unit 35*a*. The ordinary-sheet setting position, at which ordinary-size sheets must be placed, is set somewhere between the bottom of the main part 31*a* of the housing 31 and the bottom of the extending part 31*b* of the housing 31. The long-sheet setting position, at which long sheets must be placed, is set higher than the bottom of the extending part 31*b* of the housing 31.

The sheet-tray control unit 35*b* moves the sheet tray 36 to the sheet-mounting preparation position set by the height setting unit 35*c* when a sheet detector 56 provided on, for example, the sheet tray 36 detects no sheets (namely, no sheets are mounted on the sheet tray 36) while the storage box 33 remains set in the housing 31, or when sheets are to be mounted on the sheet tray 36 while the storage box 33 remains pulled from the housing 31 to replenish the sheet tray 36. Further, the sheet-tray control unit 35*b* stops the lowering of the sheet tray 36 when the sheet tray 36 reaches the lowest position set by the lowest-position setting unit 35*d*.

In the sheet feeding apparatus 5 according to the first embodiment, the sheet-data acquiring unit 35*a* of the control device 35 acquires the data showing whether the sheets mounted on the sheet tray 36 are ordinary-size sheets or long sheets, in accordance with the mode the mode-change detecting mechanism 43 has detected, namely the ordinary-sheet feeding mode or the long-sheet feeding mode. Alternatively, the sheet-data acquiring unit 35*a* may acquire, from the operation button 44*a* or from the control panel 25 of the image forming apparatus 2, the data representing whether the sheets mounted on the sheet tray 36 are ordinary-size sheets or long sheets.

Further, while the sheet feeding apparatus 5 according to the first embodiment remains set in the ordinary-sheet feeding mode, the detection selecting unit 35*f* selects the tray lowest-position detector 38, the lowest-position setting unit 35*d* sets, as the lowest position, the position of the sheet tray 36 that has been detected by the tray lowest-position detector 38, and the height setting unit 35*c* sets the lowest position of the sheet tray 36 detected by the tray lowest-position detector 38, as ordinary-sheet setting position. Hence, if the sheet tray 36 holds ordinary-size sheets, the sheet-tray control unit 35*b* moves the sheet tray 36 up and down between the highest position (i.e., position higher, by a prescribed value, than the position the upper-surface detector 39 has detected about the uppermost sheet in the sheet tray 36) and the lowest position detected by the tray lowest-position detector 38. The sheet-tray control unit 35*b* moves the sheet tray 36 to the lowest position detected by the tray lowest-position detector 38, in order to replenish the sheet tray 36 with ordinary-size sheets. If the sheet feeding apparatus 5 is set in the long-sheet feeding mode, the detection selecting unit 35*f* selects the extension-tray lowest-position detector 54, the lowest-position setting unit 35*d* sets, as the lowest position, the position of the extension tray 50, which the extension-tray lowest-position detector 54 has detected, and the height setting unit 35*c* sets, as long-sheet setting position, the position the sheet tray 36 takes when the extension-tray lowest-position detector 54 detects the extension tray 50. Therefore, in order to feed long sheets, the sheet-tray control unit 35*b* moves the sheet tray 36 and the extension tray 50 up and down between the highest position (i.e., position higher, by a prescribed value, than the position where the upper-surface detector 39 has detected about the uppermost sheet in the sheet tray 36) and the lowest position detected by the extension-tray lowest-position detector 54. In order to replenish the sheet tray with new long sheets, the sheet-tray control unit 35*b* moves the sheet tray 36 and the extension tray 50 to the position detected by the extension-tray lowest-position detector 54.

Figure 5:
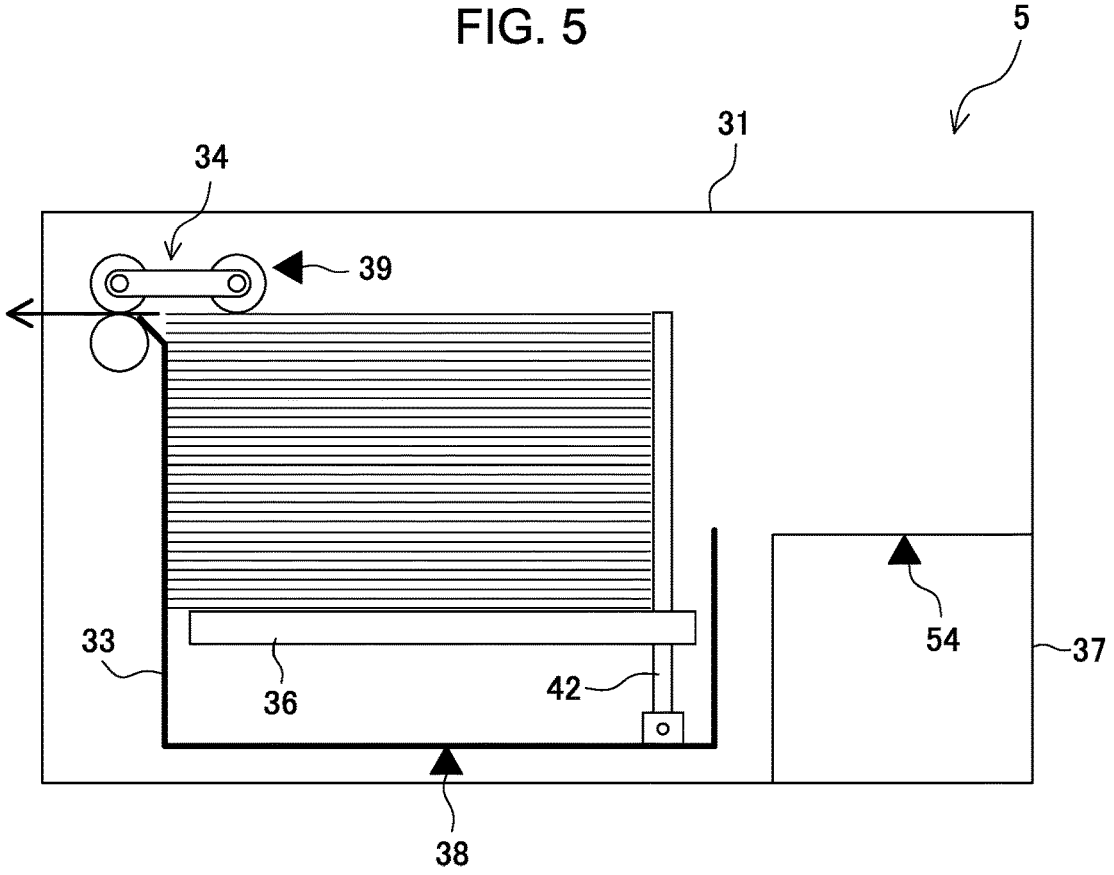
FIG. 5 is a diagram showing the interior state the sheet feeding apparatus according to the first embodiment of this invention assumes while the apparatus is feeding a sheet of ordinary size.
Figure 6:
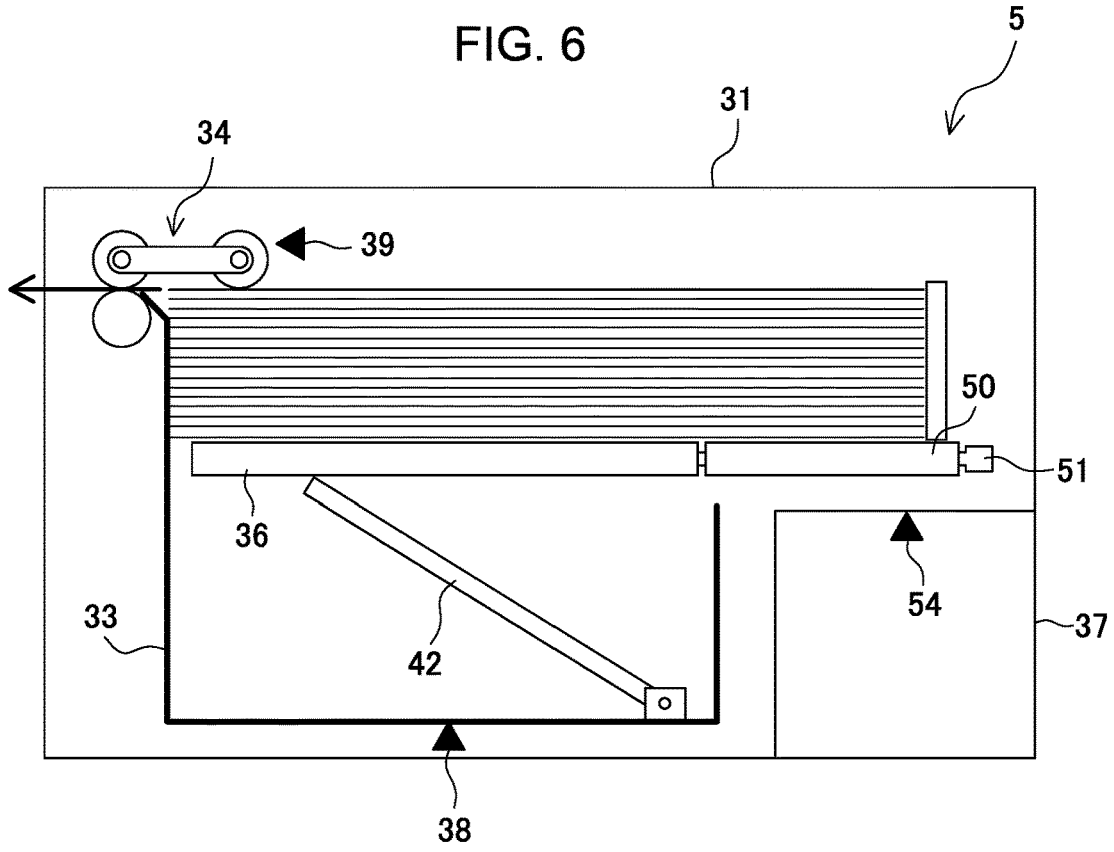
FIG. 6 is a diagram showing the interior state the sheet feeding apparatus according to the first embodiment of this invention assumes while the apparatus is feeding a long sheet.

In the sheet feeding apparatus 5 configured as described above, in the ordinary-sheet feeding mode of feeding ordinary-size sheets, the sheet tray 36 and the extension tray 50 are de-coupled from each other as shown in FIG. 5. Then, the sheet rear-end adjusting member 42 is rotated to the sanding position, and ordinary-size sheets are mounted on the sheet tray 36 in the storage box 33, and the sheet tray 36 is moved up until the uppermost sheet reaches a prescribed height. The sheet separating/feeding mechanism 34 then feeds the sheets, one by one, to the image forming apparatus 2. On the other hand, in the long-sheet feeding mode of feeding long sheets, the sheet tray 36 is lifted higher than the bottom of the extending part 31*b* as shown in FIG. 6. The sheet rear-end adjusting member 42 is then rotated, not preventing long sheets from being mounted on the sheet tray 36. The distal end of the sheet rear-end adjusting member 42 is thereby positioned below the sheet tray 36. Then, the extension tray 50 is coupled to the extension tray 50, and long sheets are amounted on the sheet tray 36. At this point, that end part of any long sheet, which is rear in the sheet-feeding direction and which protrudes from the storage box 33 and extends from the sheet tray 36, is supported by the extension tray 50 coupled to that side of the sheet tray 36, which is remote from the image forming apparatus 2. As the sheet tray 36 is moved up, the extension tray 50 now coupled to the sheet tray 36, is also moved up to the prescribed height, while keeping the uppermost long sheet in a substantially horizontal position. The uppermost long sheet is then fed to the image forming apparatus 2 by the sheet separating/feeding mechanism 34.

The sheet feeding apparatus 5 can thus hold a great number of sheets in the housing 31, not exposing them to the outside environment, and can feed not only ordinary-size sheets, but also long sheets that protrude, in part, from the sheet tray 36. Further, the extension tray 50, which is coupled to the sheet tray 36, can be moved up and down by the lift mechanism 40 of the sheet tray 36 and, hence, no separate lift mechanisms need be provided to move the extension tray 50 up and down. This can simplify the configuration of the sheet feeding apparatus 5.

Further, a long sheet is larger and heavier than an ordinary-size sheet. Therefore, if long sheets are mounted on the sheet tray 36 in the same number as ordinary-size sheets, the lift motor M1 of the lift mechanism 40 must generate a larger output than the output for lifting the sheet tray 36 holding ordinary-size sheets. In the first embodiment shown in the drawing, however, the extending part 31*b* is arranged, with its bottom located above the bottom of the main part 31*a* of the housing 31. Hence, the sheet tray 36 must be moved up above the bottom of the extending part 31*b*, which lies above the bottom of the main part 31*a*, in order to feed long sheets from the sheet tray 36. This is why the sheet-tray control unit 35*b* is configured to move the sheet tray 36 to the sheet-mounting preparation position above the bottom of the extending part 31*b*, which is positioned above the bottom of the main part 31*a*. As a result of this, the number of long sheets that can be mounted, each mainly on the sheet tray 36 and partly on extension tray 50, is smaller than the number of ordinary-size sheets that can be mounted on the sheet tray 36. This can step down the largest number, in which long sheets can be mounted on the sheet tray. Long sheets can therefore be fed by using the lift motor M1 having an output for feeding ordinary-size sheets.

As described above, the sheets of the first type are ordinary-size sheets, and the sheets of the second type are long sheets. Nonetheless, this invention can be applied to a sheet feeding apparatus for feeding small-size sheets which can be mounted in the sheet tray 36 and large-size sheets which are larger than the small-size sheets and which extend, in part, from the sheet tray 36. Needless to say, this sheet feeding apparatus achieves the same advantage as the sheet feeding apparatus described above.

Figure 7:
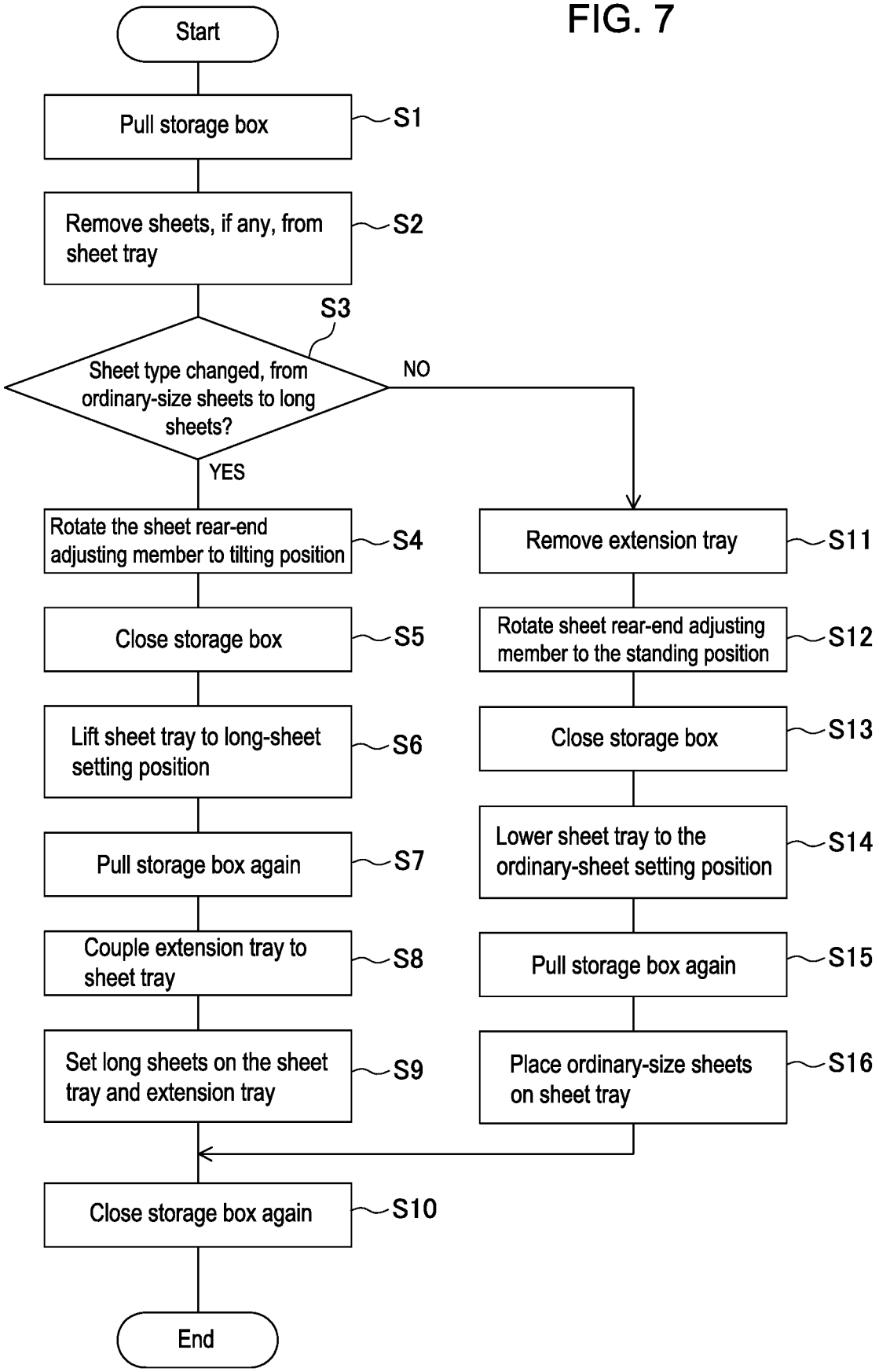
FIG. 7 is a flowchart showing the sequence of placing sheets in the sheet feeding apparatus according to the first embodiment of this invention.

With reference to FIG. 7, the sequence of changing the type of sheets to be stored in the sheet feeding apparatus 5 will be explained with reference to FIG. 7.

When the operator pushes the unlock button 44*b* provided on the upper surface of the sheet feeding apparatus 5 for the purpose of unlocking the storage box 33, the sheet tray 36 is lowered, unlocking the storage box 33. As a result, the storage box 33 can be drawn from the housing 31. In the first embodiment illustrated, when the storage box 33 is drawn from the housing 31, the sheet tray 36 is moved to the ordinary-sheet setting position (i.e., lowest position detected by the tray lowest-position detector 38) in the ordinary-sheet feeding mode, and is moved to the long-sheet setting position (i.e., lowest position where the extension tray 50 is detected by the extension-tray lowest-position detector 54) in the long-sheet feeding mode. Once the storage box 33 is unlocked, the operator pulls the storage box 33 at the front (the near side in FIG. 2) of the housing of the sheet feeding apparatus 5 (Step 1). If sheets remain on the sheet tray 36 located in the storage box 33, the operator removes these sheets from the sheet tray 36 (Step S2).

Next, it is determined whether long sheets should be stored in the sheet feeding apparatus 5, instead of ordinary-size sheets (Step S3). If YES, the storage box 33 is pulled from the housing 31, and the sheet rear-end adjusting member 42 is rotated from the standing position to the tilting position (Step S4). Then, the storage box 33 is closed and is inserted into the housing 31 (Step S5). Since the sheet tray 36 has a window 36*c*, the sheet tray 36 would not interfere with the sheet rear-end adjusting member 42 when tilted, no mater whichever position it takes.

When the storage box 33 is closed, the sheet rear-end adjusting member 42 is rotated to the tilting position. Then, the detecting flag 43*a* of the mode-change detecting mechanism 43 can no longer be detected by the mode-change detector 43*c*. It is therefore detected that the sheet feeding apparatus 5 has been switched to the long-sheet feeding mode. The sheet-data acquiring unit 35*a* determines that the sheets mounted on the sheet tray 36 are long sheets, and the sheet detector 56 determines that the sheet tray 36 holds no sheets. The detection selecting unit 35*f* therefore selects the extension-tray lowest-position detector 54, and the height setting unit 35*c* sets, as sheet-mounting preparation position, the long-sheet setting position higher than the bottom of the extending part 31*b*. Further, the lowest-position setting unit 35*d* sets, as lowest possible position, the height at which the sheet tray 36 stays when the extension-tray lowest-position detector 54 detects the extension tray 50. As a result, the sheet-tray control unit 35*b* lifts the sheet tray 36 to the long-sheet setting position (Step S6). The sheet tray 36 is moved up from the ordinary-sheet setting position to the long-sheet setting position, under the control of the encoder EC shown in FIG. 2. That is, the number of pulses of the encoder EC, equivalent to the distance from the ordinary-sheet setting position to the long-sheet setting position, is preset in the sheet-tray control unit 35*b*, and the sheet-tray control unit 35*b* controls the lift motor M1, stopping the sheet tray 36, when the number of pulses output from the encoder EC reaches the preset value. Further, if the sheet detector 56 detects any sheet on the sheet tray 36, the sheet tray 36 is not moved upward, and an alarm is generated, informing that the operator has made an error or has forgotten to take out the sheet. The operating mode of the sheet feeding apparatus 5 may be switched to the long-sheet feeding mode, either by selecting the mode at the control panel 25 or by pushing the operation button 44*a*). However, since the sheet rear-end adjusting member 42 must be rotated to the tilting position to insert long sheets into the housing 31, the switching of the operating mode, from ordinary-sheet feeding mode to the long-sheet feeding mode, should better be determined by the mode-change detecting mechanism 43 in order to confirm that the sheet tray can hold long sheets.

When the sheet tray 36 is moved up to the long-sheet setting position, the operator again pulls the storage box from the housing 31 of the sheet feeding apparatus 5 (Step S7). The operator then couples the extension tray 50 to the sheet tray 36 (Step S8). To couple the extension tray 50 to the sheet tray 36, the connecting shafts 51 are inserted into the through holes made in the extension tray 50, while the extension tray 50 opposes, at one side, to that end of the sheet tray 36, which is rear as viewed in the sheet-feeding direction. Then, the male screws provided on the distal ends of the connecting shafts 51 are engaged in the screw holes made in that side of the sheet tray 36, which is rear in the sheet-feeding direction. The method of coupling the extension tray 50 to the sheet tray 36 is not limited to this, nonetheless. The extension tray 50 can be coupled to the sheet tray 36 by any other method available.

After the extension tray 50 is coupled to the sheet tray 36, long sheets are mounted, each on the sheet tray 36 and the extension tray 50, and are set at a prescribed position (Step S9). Then, the storage box 33 is closed again and inserted into the housing 31 (Step S10). The sheet-side adjusting members 41*a* and 41*b*, long-sheet side adjusting members 52*a* and 52*b* and long-sheet rear-end adjusting member 53 are moved to prescribed positions. As a result, each long sheet has its both sides abut on the sheet-side adjusting members 41*a* and 41*b* and on the long-sheet side adjusting members 52*a* and 52*b*, and has its rear end (as viewed in sheet-feeding direction) abut on the long-sheet rear-end adjusting member 53. The long sheets are thereby arranged at a prescribed position. The front wall of the extending part 31*b* is gradually spaced from the extending part 31*b* as the storage box 33 is pulled out. Therefore, the extension tray 50 does not interfere with the wall of the extending part 31*b* as the storage box 33 is pulled out from the housing 31. Once rotated, with its distal end positioned below the sheet tray 36 set in the long-sheet setting position, the sheet rear-end adjusting member 42 never prevents the long sheet from extending from the sheet tray 36 onto the extending part 31*b* of the housing 31.

If NO in Step S3, namely if the operating mode is changed from the long-sheet feeding mode to the ordinary-sheet feeding mode, the storage box 33 is pulled from the housing 31. Then, the male screws provided on ends of the connecting shafts 51 are disengaged from the screw holes made in the sheet tray 36, and the connecting shafts 51 are pulled from the through holes of the extension tray 50. The extension tray 50 is thereby removed from the sheet tray 36 (Step S11). When the storage box 33 is pulled from the housing 31, the sheet feeding apparatus 5 is set in the long-sheet feeding mode. The detection selecting unit 35*f* therefore selects the extension-tray lowest-position detector 54, and the lowest-position setting unit 35*d* sets the lowest position for the sheet tray 36 to the position where the extension-tray lowest-position detector 54 detects the extension tray 50. The sheet tray 36 and the extension tray 50 are therefore positioned above, at least, the bottom of the extending part 31*b*. In this embodiment, the position at which the extension-tray lowest-position detector 54 detects the extension tray 50 is set as position where long sheets should be placed (i.e., sheet-mounting preparation position for long sheets). The sheet tray 36 and the extension tray 50 are therefore lowered by the sheet-tray control unit 35*b* to the position where the extension tray 50 is detected by the extension-tray lowest-position detector 54 when the storage box 33 is pulled from the housing 31. Further, since the front outer wall of the extending part 31*b* of the housing 31 leaves the extending part 31*b* as the storage box 33 is drawn from the housing 31, the extension tray 50 never interferes with the front outer wall of the extending part 31*b* when the storage box 33 is drawn from the housing 31. Next, the sheet rear-end adjusting member 42 is rotated from the tilting position to the standing position (Step S12). Then, the storage box 33 is closed and inserted into the housing 31 (Step S13). Since the sheet tray 36 has the window 36*c*, the sheet rear-end adjusting member 42, when tilted, never interferes with the sheet tray 36, no matter whichever position the sheet tray 36 assumes.

When the storage box 33 is closed, the sheet rear-end adjusting member 42 is rotated to the standing position. Then, the mode-change detector 43*c* detects the detecting flag 43*a* of the mode-change detecting mechanism 43, determining that the operation mode of the sheet feeding apparatus 5 has been switched to the ordinary-sheet feeding mode. The sheet-data acquiring unit 35*a* therefore determines that ordinary-size sheets should be fed and the sheet detector 56 detects that no sheets are mounted on sheet tray 36. In this case, the detection selecting unit 35*f* selects the tray lowest-position detector 38. Then, the height setting unit 35*c* sets, as sheet-mounting preparation position, the ordinary sheet setting position defined at the bottom of the main part 31*a* of the housing 31, and the lowest-position setting unit 35*d* sets, as lowest position, the height position detected by the tray lowest-position detector 38. As a result of this, the sheet-tray control unit 35*b* lowers the sheet tray 36 to the ordinary-sheet setting position (Step S14). The operating mode may be switched to the ordinary-sheet feeding mode, by selecting the ordinary-sheet feeding mode at the control panel 25 or by pushing the operation button 44*a*. It is desirable, however, that the mode-change detecting mechanism 43 should determine the mode changing (from the ordinary-sheet feeding mode, or vice versa), in order to determine that the sheet rear-end adjusting member 42 takes the standing position and that the sheet tray 36 is prepared to hold ordinary-size sheets.

When the sheet tray 36 is lowered to the ordinary-sheet setting position, the storage box 33 is pulled again from the housing 31 of the sheet feeding apparatus 5 (Step S15). Then, ordinary-size sheets are placed on the sheet tray 36 and are thereby set at the prescribed position (Step S16). After placing the ordinary-size sheets on the sheet tray 36, the storage box 33 is closed and inserted into the housing (Step S10). On the sheet tray 36, the ordinary-size sheets are set at a prescribed position as the sheet-side adjusting members 41*a* and 41*b* and the sheet rear-end adjusting member 42 are moved to the preset positions, making each sheet abut, at both sides, on the sheet-side adjusting members 41*a* and 41*b*, and making the rear end of each sheet abut on the sheet rear-end adjusting member 42 rotated to the standing position.

Figure 8:
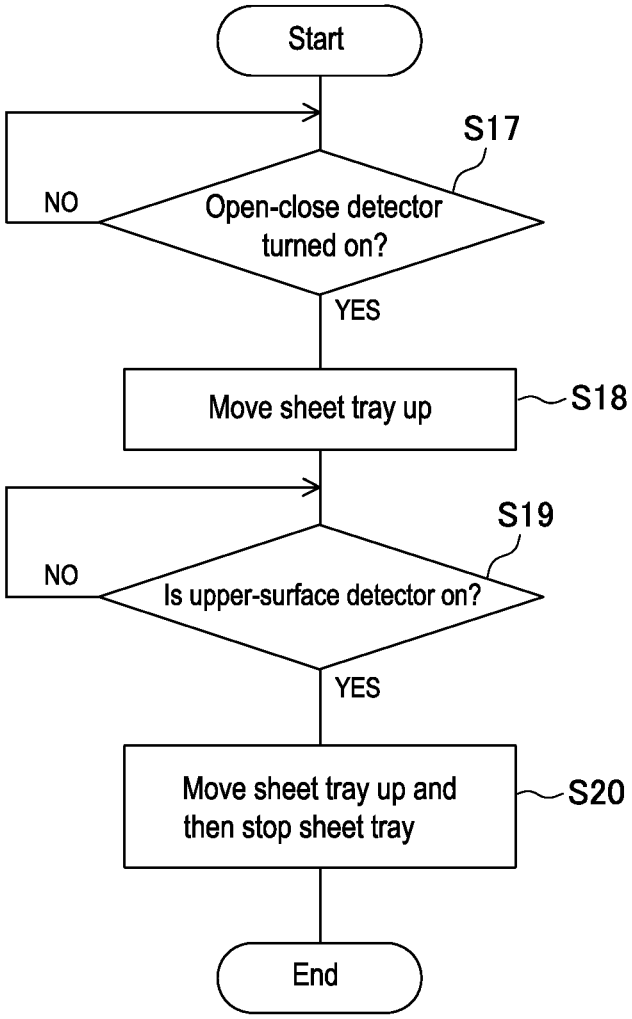
FIG. 8 is a flowchart showing the sequence of setting the sheet feeding apparatus to a waiting state after sheets have been placed on the sheet tray.

When the storage box 33 is inserted into the housing 31 and then closed, the sheet-tray control unit 35*b* lifts the sheet tray 36 until the uppermost sheet on the sheet tray 36 reaches the feeding-out position as is shown in FIG. 8. More specifically, when the storage box 33 is closed and the open-close detector (not shown) is thereby turned on (YES in Step S17), the sheet-tray control unit 35*b* controls the lift motor M1, moving the sheet tray 36 up (Step S18). When the uppermost sheet on the sheet tray 36 abuts, at its upper surface, on the sheet feeding roller 45, the upper-surface detector 39 detects the upper surface of the uppermost sheet and is therefore turned on (YES in Step S19). Then, the sheet tray 36 is moved up, by a prescribed distance, from the position where the upper-surface detector 39 has been turned on, and the lift motor M1 is stopped, stopping the sheet tray 36 (Step S20). The uppermost sheet on the sheet tray 36 is thereby set at the sheet feeding position, and can therefore be fed from the sheet tray 36.

Figure 3:
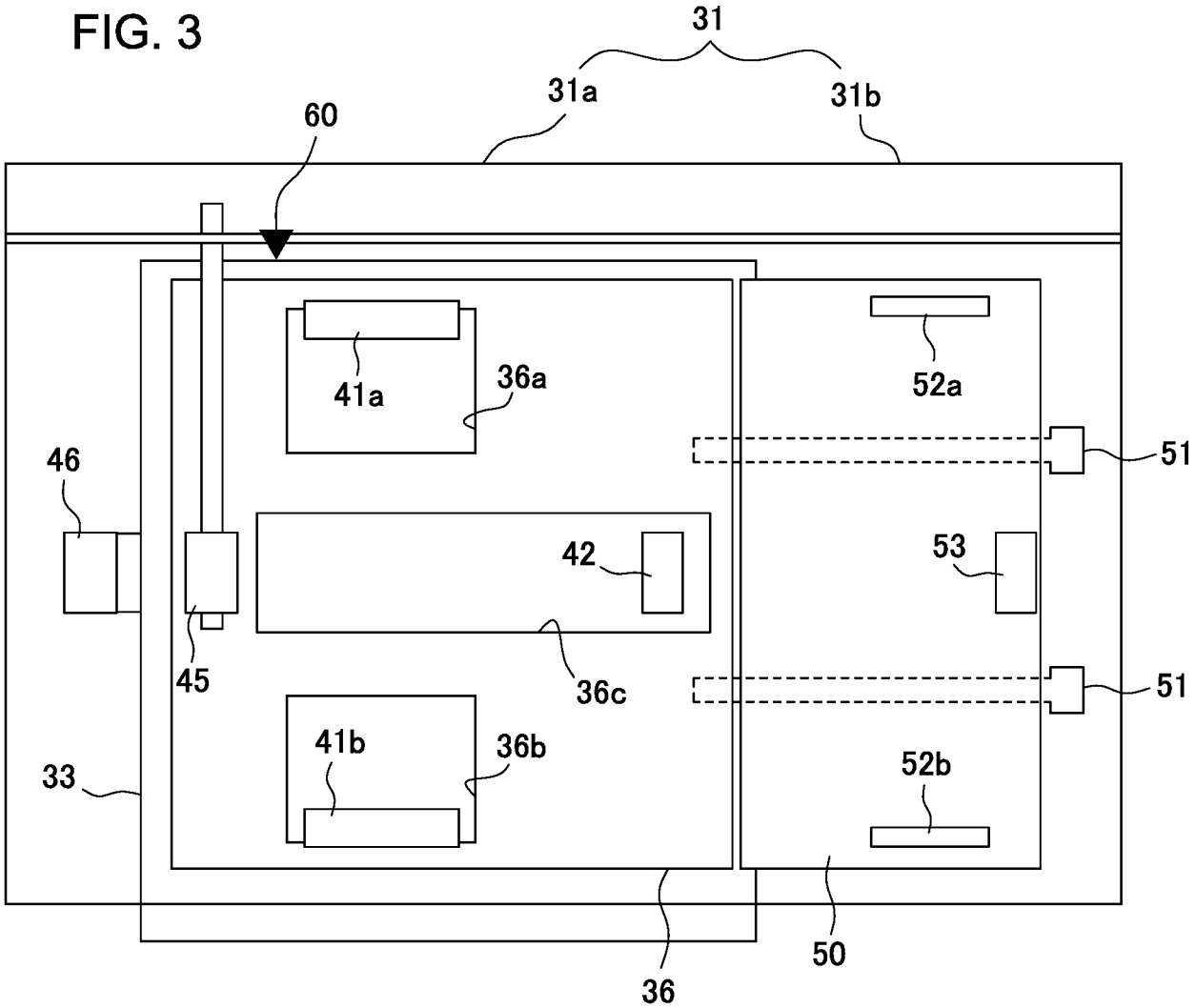
FIG. 3 is a diagram explaining the interior, viewed from above, of the sheet feeding apparatus according to the first embodiment of this invention.

As shown in FIG. 3, the open-close detector 60 is provided in the housing of the sheet feeding apparatus 5. The open-close detector 60 is turned on when the storage box 33 is closed, and is turned off when the storage box 33 is pulled from the housing 31. Therefore, if the open-close detector 60 is ON in Step S5, Step S10 or Step S13, the operation goes to the next step, and if the open-close detector 60 is OFF in Step S1, Step S7 or Step S15, the operation goes to the next step.

Figure 9:
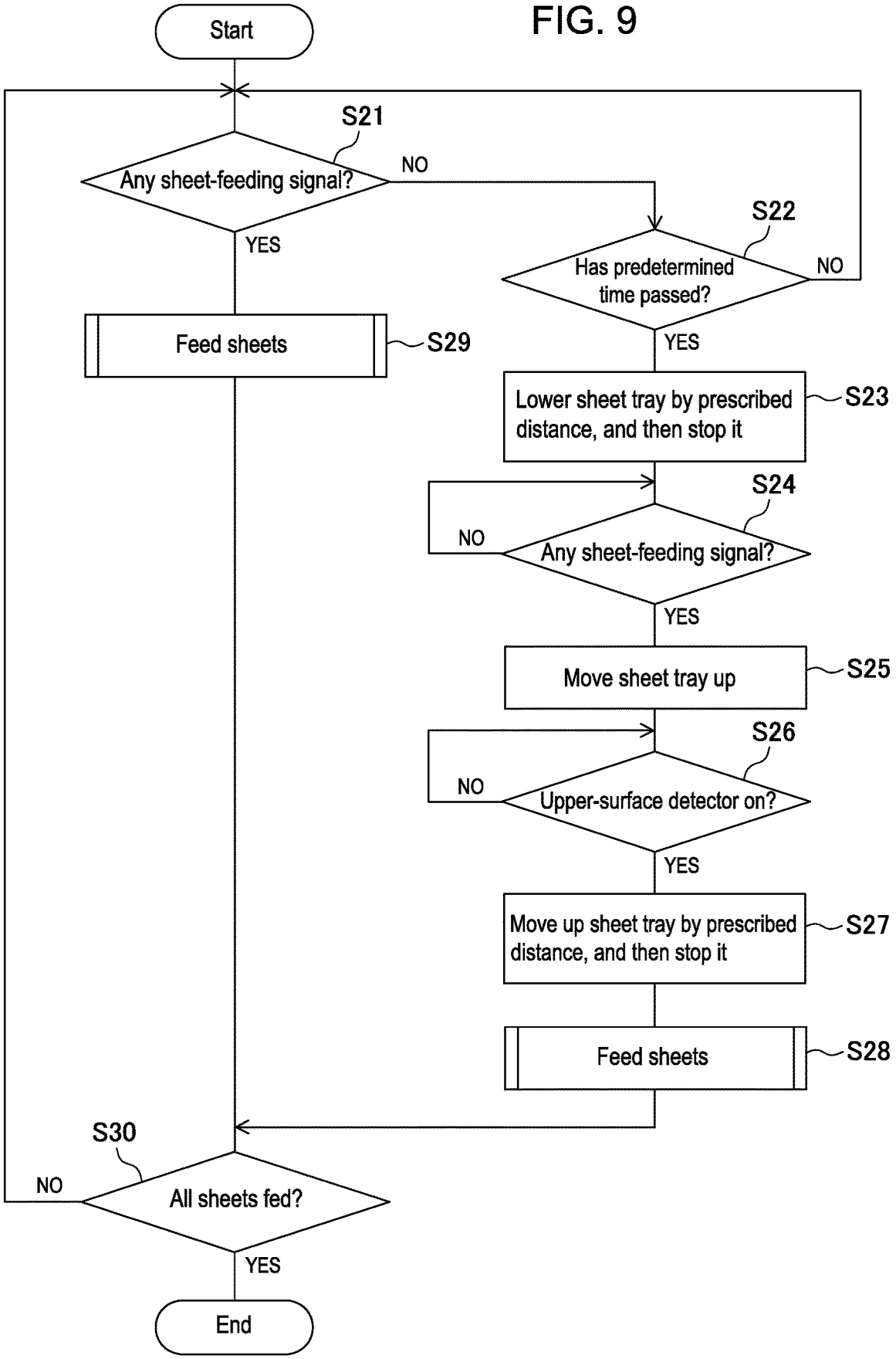
FIG. 9 is a flowchart showing, in detail, how a sheet is fed.
Figure 10:
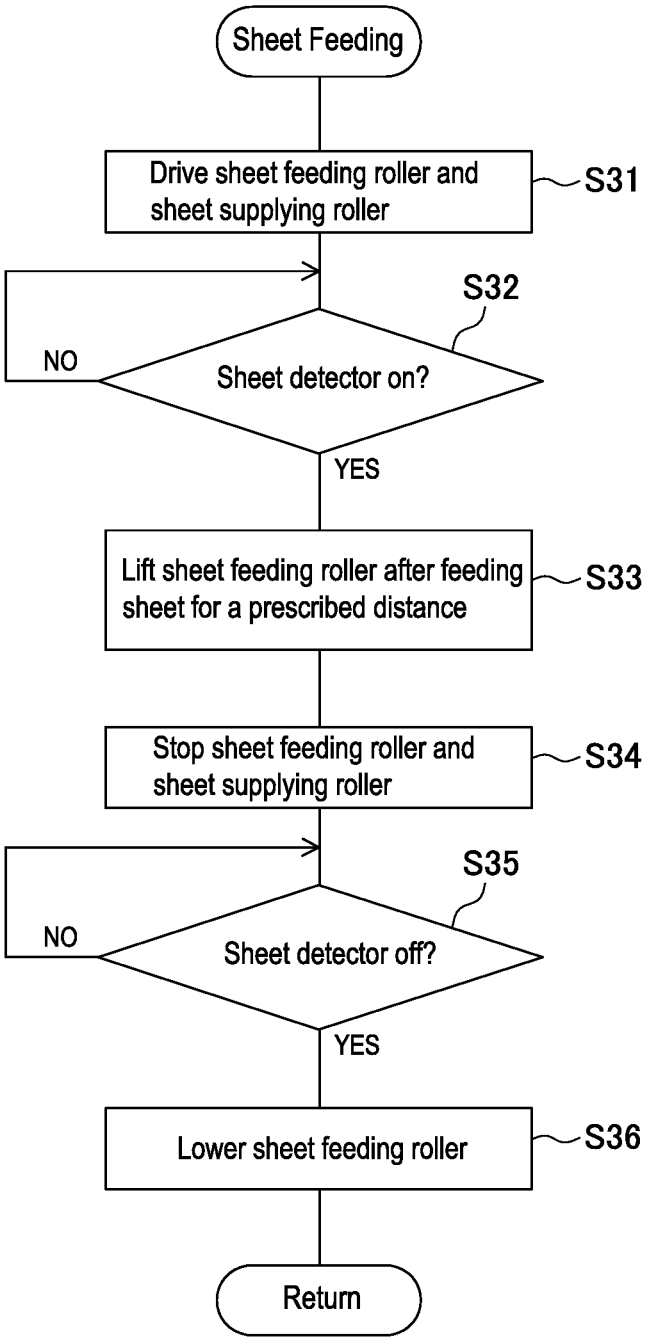
FIG. 10 is a flowchart representing, in detail, a process of feeding a sheet.

The sheet-feeding process will be explained with reference to FIG. 9 and FIG. 10.

After the upper surface of the uppermost sheet on the sheet tray 36 is set at the feeding position, it is determined whether a sheet-feeding signal has come from the image forming apparatus 2 (Step S21). If NO in Step S21, it is determined whether a predetermined time has passed without receiving any signal from the image forming apparatus 2 (Step S22). If YES in Step S22, the sheet-tray control unit 35*b* drives the lift motor M1. The sheet tray 36 is thereby lowered by a prescribed distance and is then stopped at the position where the upper surface of the uppermost sheet leaves the sheet feeding roller 45 (Step S23). The sheet tray 36 is thus stopped at the stop position where the upper surface of the uppermost sheet is spaced from the sheet feeding roller 45. This can prevent the roller 45 from leaving its trace on the upper surface of the sheet.

While the sheet tray 36 stays at stop position, a sheet-feeding signal may be supplied from the image forming apparatus 2 (YES in Step S24). In this case, the sheet-tray control unit 35*b* drives the lift motor M1, moving the sheet tray 36 upwards (Step S25). So moved, the upper surface of the uppermost sheet on the sheet tray 36 abuts on the sheet feeding roller 45, turning on the upper-surface detector 39 (Step S26). At this moment, the sheet-tray control unit 35*b* causes the sheet tray 36 to move up by a predetermined distance and stops the lift motor M1, stopping the upward motion of the sheet tray 36 (Step S27). The upper surface of the uppermost sheet on the sheet tray is thereby set at the position where the sheet feeding roller 45 can feed the uppermost sheet. Then, the uppermost sheet is fed to the image forming apparatus 2 (Step S28).

In Step S21, the control device 35 may receive a sheet-feeding signal from the image forming apparatus 2 before the predetermined time passes after the upper surface of the uppermost sheet on the sheet tray 36 is set at the position where it can be fed. If this is the case, the uppermost sheet is fed as will be described later (Step S29).

The process sequence described above is repeated until the last sheet is fed from the sheet tray 36 (Step S30).

In the sheet feeding process, the sheet feeding control unit 35*e* drives the sheet feeding motor M2 while the upper surface of the uppermost sheet on the sheet tray 36 is arranged, abutting on the sheet feeding roller 45 at the feeding-out position, causing the sheet feeding roller 45 and the sheet supplying roller 46 to rotate. The uppermost sheet is thereby fed by the sheet feeding roller 45 and separated from the next sheet by the sheet supplying roller 46 and sheet separating roller 47, and is fed to the image forming apparatus 2 (Step S31). Then, a sheet detector 55 detects the front end of the sheet (as viewed in the sheet-feeding direction) being so fed and is therefore turn on (YES in Step S32). In this case, the sheet feeding control unit 35*e* drives the solenoid 49 when the sheet is fed for a prescribed distance from the time the sheet detector 55 was turned on (namely, the time the front end of the sheet was detected). The sheet feeding roller 45 is thereby lifted from the upper surface of the uppermost sheet on the sheet tray 36 to its waiting position (Step S33). At the same time the sheet feeding roller 45 is so lifted, the sheet feeding motor M2 is stopped, stopping the rotation of the sheet feeding roller 45 and the sheet supplying roller 46 (Step S34).

When the sheet so fed is transported by a prescribed distance after its front end (as viewed in the sheet-feeding direction) has been detected by the sheet detector 55, the front end of the sheet is nipped by the transport rollers 16*a*. Therefore, the sheet is further fed, being pulled by the transport rollers 16*a* from the nip between the sheet supplying roller 46 and the sheet separating roller 47. The sheet feeding roller 45 is lifted to its waiting position and spaced from the sheet in step S33 as described above. This can reduce the sheet-pulling load at the time the transport rollers 16*a* feed the sheet to the image forming apparatus 2. Further, this can prevent the roller 45 from leaving dirt or its trace on the sheet.

When the sheet is fed into the image forming apparatus 2 and the sheet detector 55 is therefore turned off, namely when the rear end of the sheet passes the sheet detector 55 (YES in Step S35), the sheet feeding control unit 35*e* stops the solenoid 49 operating, to move the sheet feeding roller downward (Step S36). The sheet feeding process is thereby performed.

Figure 11:
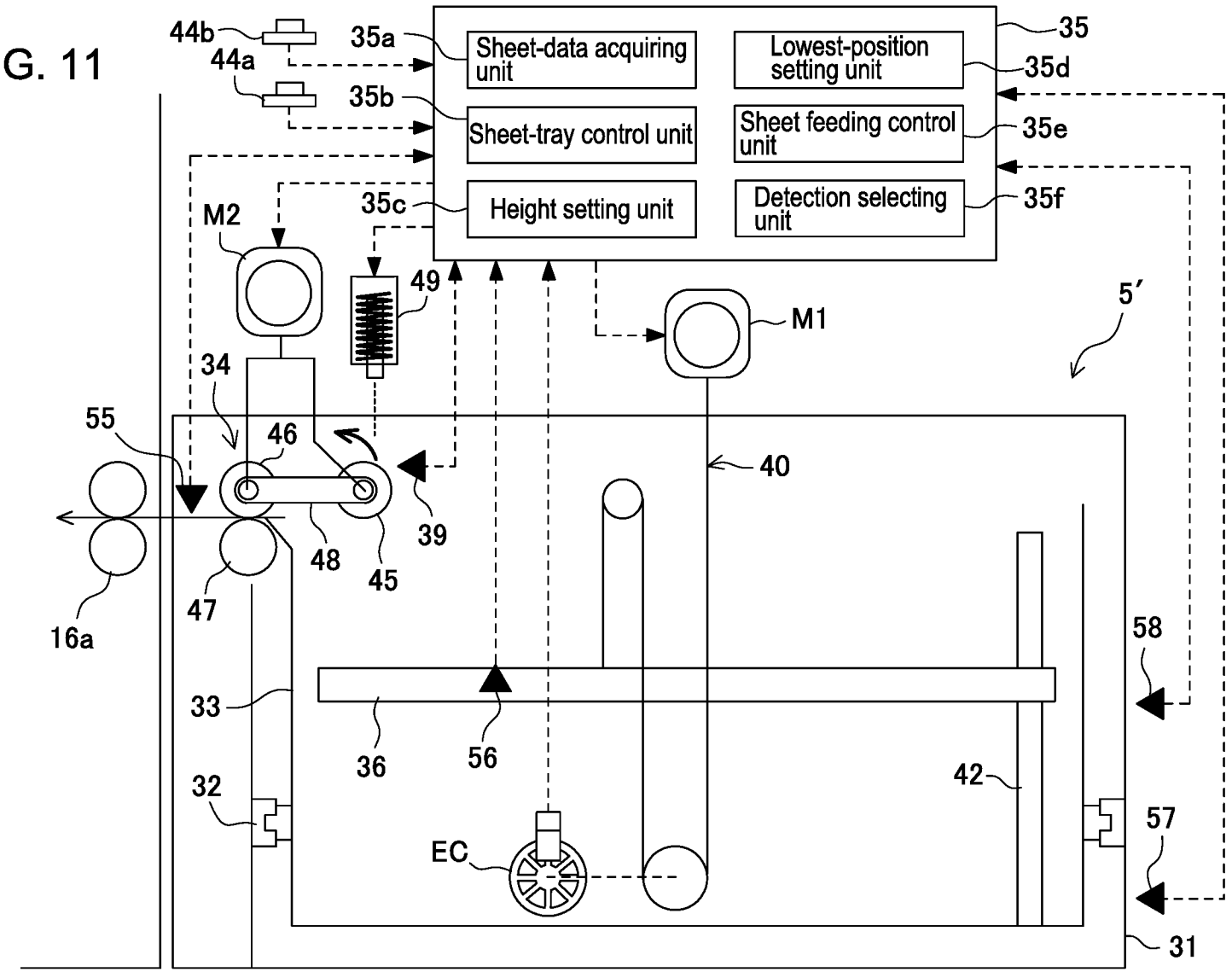
FIG. 11 a diagram showing the inner configuration of a sheet feeding apparatus according to a second embodiment of this invention.
Figure 12:
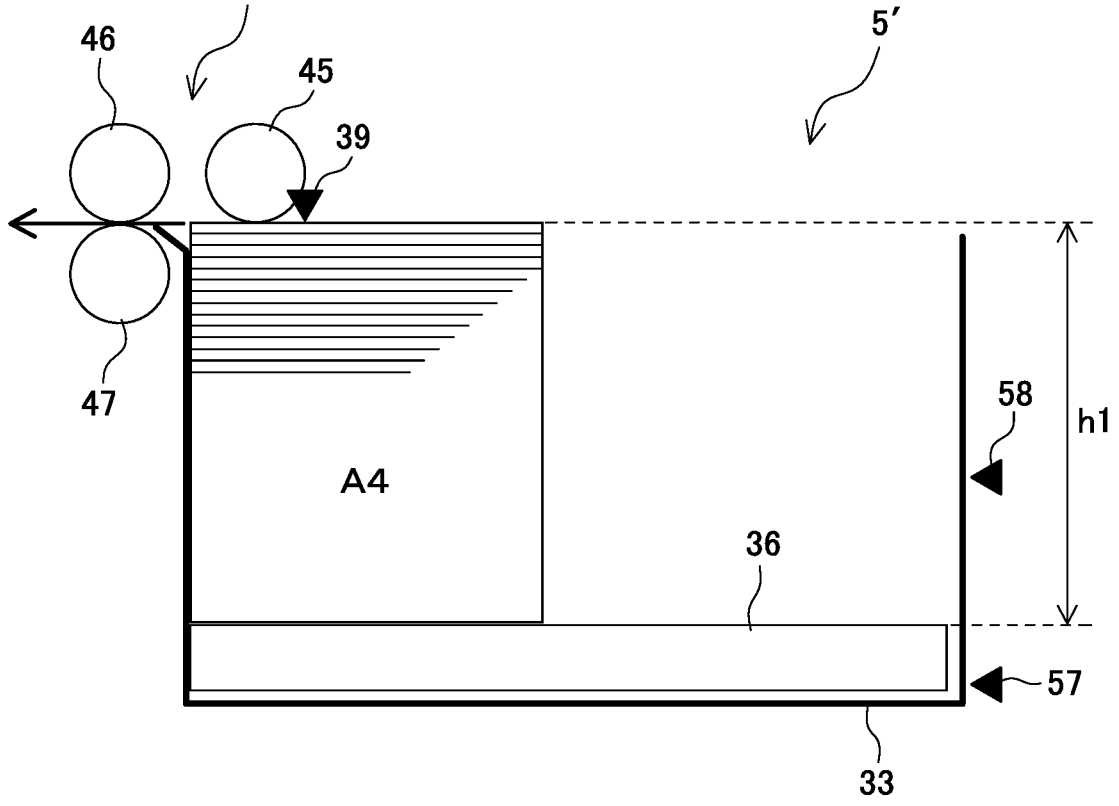
FIG. 12 is a diagram explaining the position the sheet tray takes while holding small-size sheets such as A4 sheets.
Figure 13:
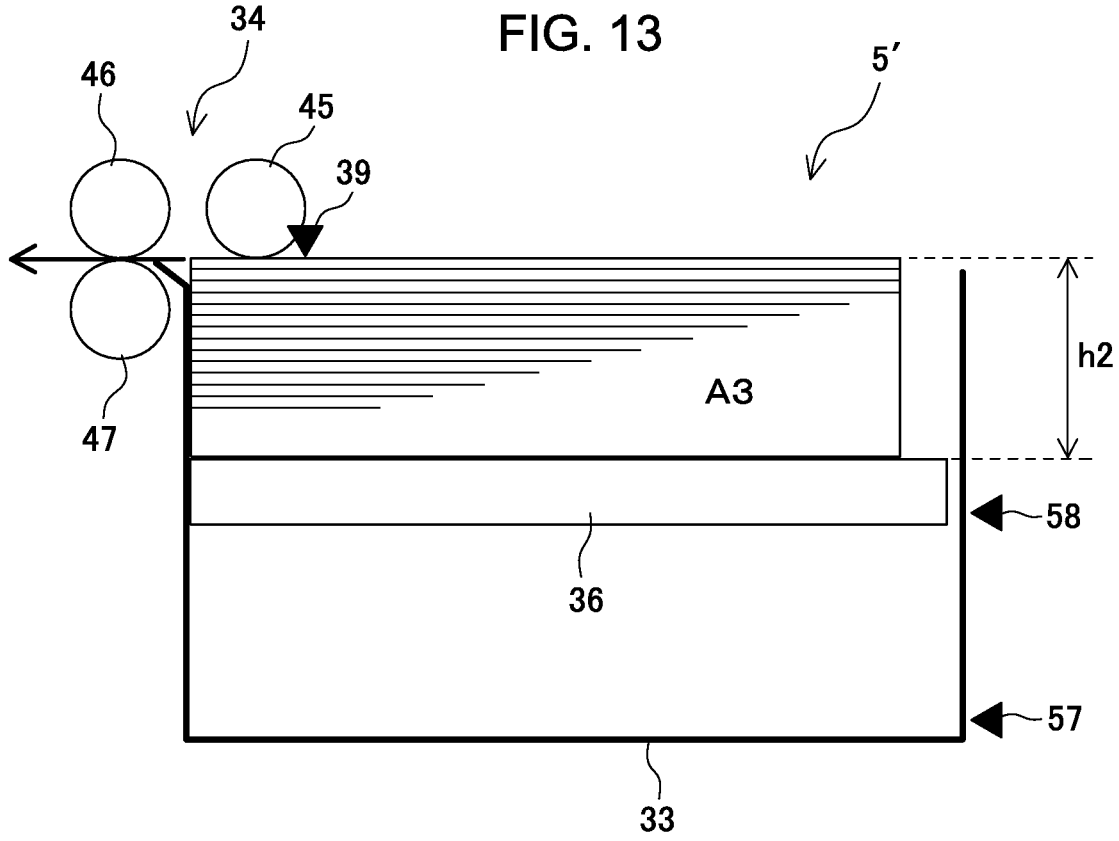
FIG. 13 a diagram explaining the position the sheet tray takes while holding large sheets such as A3 sheets.

A sheet feeding apparatus 5' according to the second embodiment of this invention will be described hereinafter, with reference to FIG. 11 to FIG. 13. In FIG. 11 to FIG. 13, the components identical in function to those of the first embodiment are designated by the same reference numbers.

The sheet feeding apparatus 5' according to the second embodiment differs from the sheet feeding apparatus 5 according to the first embodiment, in that it does not have an extending part 31*b*. The sheet feeding apparatus 5' comprises a housing 31, a storage box 33, a sheet separating/feeding mechanism 34, and a control device 35. The storage box 33 is provided in the housing 31 and can be pulled from the housing 31 by a pulling mechanism, in a direction perpendicular to the sheet-feeding direction. The sheet separating/feeding mechanism 34 separates one sheet from the other sheets stored in the storage box 33 and then feeds the sheet to the image forming apparatus 2. The control device 35 controls the sheet feeding apparatus 5'. In the storage box 33, a sheet tray 36 is provided, which can be moved up and down. The sheet tray 36 is a plate, and can hold sheets of first type having a size equal to or smaller than a prescribed size (hereinafter referred to as "small-size sheets") and sheets of second type larger than the prescribed size (hereinafter referred to as "large-size sheets"). Both the small-size sheets and the large-size sheets can be mounted, in their entirety, on the sheet tray 36. At the top of the storage box 33, an upper-surface detector 39 is arranged to detect the upper surface of the uppermost sheet mounted on the sheet tray 36. Therefore, the sheet tray 36 can be moved by a lift mechanism 40 in accordance with the number of sheets mounted on the sheet tray 36. The sheet tray 36 has the same configuration as in the sheet feeding apparatus 5 according to the first embodiment, and is not described here.

The storage box 33 has an opening in the top. Through the opening, sheets can be mounted into the storage box 33 and mounted on the sheet tray 36 provided in the storage box 33 when the storage box 33 remains pulled from the housing 31. The storage box 33 has a tray storage space for storing sheets. In the tray storage space, a sheet-side adjusting members (not shown) and a sheet rear-end adjusting member 42 are provided. The sheet-side adjusting members are spaced apart in the widthwise direction (perpendicular to the sheet-feeding direction) to hold sheets therebetween. The sheet rear-end adjusting member 42 is positioned at the rear end of any sheet mounted on the sheet tray 36. The sheet-side adjusting members adjust the position of the lateral edges of any sheet mounted on the sheet tray 36. The sheet rear-end adjusting member 42 adjusts the position of the rear end of any sheet (as viewed in the sheet-feeding direction) mounted on the sheet tray 36. In the second embodiment shown, the sheet-side adjusting members stand on the bottom of the storage box 33, can slide in unison with each other in the widthwise direction of the sheet, and extend through a window (not shown) made in the sheet tray 36, to allow a sheet to move in its widthwise direction. In the second embodiment, the sheet rear-end adjusting member 42 stands on the bottom of the storage box 33, can slide in the sheet-feeding direction, and penetrates the window (not shown) made in the sheet tray 36, to allow a sheet to move in the sheet-feeding direction. In Therefore, the sheet-side adjusting members and the sheet rear-end adjusting member 42 can be moved on the bottom of the storage box 33, to adjust the positions of the lateral edges and rear end of any sheet mounted on the sheet tray 36 in accordance with the size of the sheet.

At the lowest position the sheet tray 36 at the bottom of the sheet tray 36 may take, a first tray detector 57 is provided to detect the sheet tray 36. Above the lowest position the sheet tray 36 may take, a second tray detector 58 is arranged to detect the sheet tray 36.

As in the first embodiment, the sheet separating/feeding mechanism 34 includes a sheet feeding roller 45 and a sheet-separating/transporting unit. The sheet feeding roller 45 contacts the upper surface of the uppermost sheet held in the sheet tray 36 and feeds the uppermost sheet to the image forming apparatus 2. The sheet-separating/transporting unit separates sheets from one another and transports the separated sheet to the image forming apparatus 2, and comprises a sheet supplying roller 46 and a sheet separating roller 47. The sheet separating roller 47 is pressed onto the sheet supplying roller 46, and prevents the feeding of the second sheet and any following sheet. The sheet supplying roller 46 is rotated by a sheet feeding motor M2, via gears (not shown) or a timing belt (not shown), and feeds a sheet as the sheet feeding motor M2 is driven. The sheet feeding roller 45 is supported by a bracket 48 rotatably mounted on the shaft of the sheet supplying roller 46, and is rotated as the rotation of the shaft of the sheet supplying roller 46 is transmitted by the sheet supply motor M2 to the sheet feeding roller 45 via a plurality of gears. Further, the sheet feeding roller 45 can be rotated around the shaft of the sheet supplying roller 46, between an operating position where it contacts the upper surface of the sheet and a waiting position where it stays far from the upper surface of the sheet. In this embodiment, a solenoid 49 is turned on and off repeatedly, rotating the bracket 48 around the shaft of the sheet supplying roller 46. The sheet feeding roller 45 is thereby moved between the operating position and the waiting position. This configuration is identical to the corresponding configuration used in the first embodiment, and will not be described here in detail.

The control device 35 includes a sheet-data acquiring unit 35*a*, a sheet-tray control unit 35*b*, a height setting unit 35*c*, a lowest-position setting unit 35*d*, a sheet feeding control unit 35*e*, and a detection selecting unit 35*f*. The sheet-data acquiring unit 35*a* acquires the data representing the type of the sheets mounted on the sheet tray 36. The sheet-tray control unit 35*b* controls the up-down motion of the sheet tray 36. The sheet feeding control unit 35*e* controls the sheet separating/feeding mechanism 34. The height setting unit 35*c* sets, based on the sheet type represented by the sheet data acquired by the sheet-data acquiring unit 35*a*, the height (hereinafter referred to as "sheet-mounting preparation position") at which the sheet tray 36 should be stopped to receive new sheets. The lowest-position setting unit 35*d* sets the lowest position that the sheet tray 36 should take, based on the sheet type represented by the sheet data acquired by the sheet-data acquiring unit 35*a*.

The sheet-tray control unit 35*b* moves the sheet tray 36 to the sheet-mounting preparation position set by the height setting unit 35*c* if the storage box 33 remains in the housing 31 while the sheet detector 56 provided above the sheet tray 36, for example, is detecting no sheets (namely, if no sheets are mounted on the sheet tray 36), or if sheets are mounted on the sheet tray 36 while the storage box 33 remains pulled out of the housing 31 to replenish the sheet tray 36. The control device 35 stops the lowering of the sheet tray 36 when the sheet tray 36 reaches the lowest position set by the lowest-position setting unit 35*d*.

In the sheet feeding apparatus 5' according to the second embodiment (shown in the drawings), the sheet-data acquiring unit 35*a* of the control device 35 acquires, from the control panel 25 of the image forming apparatus 2, the data about the type of the sheets mounted on the sheet tray 36, which shows whether the sheets are small-size sheets having a size equal to or smaller than the prescribed size or large-size sheets larger than the prescribed size. Alternatively, the sheet-data acquiring unit 35*a* may acquire the sheet data from the operation button 44*a* or any other means. The sheet-size data and the sheet-length data can be acquired by detecting the positions of the sheet-side adjusting members 41*a* and 41*b* and sheet rear-end adjusting member 42.

In the sheet feeding apparatus 5' according to the second embodiment (shown in the drawings), the detection selecting unit 35*f* selects the first tray detector 57 if the sheet tray 36 holds small-size sheets. In this case, the lowest-position setting unit 35*d* sets the height of the sheet tray 36 (i.e., lowest position) detected by the first tray detector 57, as the lowest sheet-holding position, and the height setting unit 35*c* sets the height of the sheet tray 36 detected by the first tray detector 57, as the sheet-mounting preparation position. The sheet-tray control unit 35*b* therefore moves sheet tray 36 up or down between the highest position (to which the sheet tray 36 is lifted by a prescribed distance from the position where the upper-surface detector 39 detects the uppermost sheet on the sheet tray 36) and the lowest position where the first tray detector 57 detects the sheet tray 36. To replenish the sheet tray 36 with small-size sheets, sheet-tray control unit 35*b* moves the sheet tray 36, as shown in FIG. 12, to the lowest position where the sheet tray 36 is detected by the first tray detector 57. If the sheet tray 36 holds large-size sheets larger than small-size sheets, the detection selecting unit 35*f* selects the second tray detector 58, the lowest-position setting unit 35*d* sets, as the lowest possible position, the height at which the sheet tray 36 is detected by the second tray detector 58, and the height setting unit 35*c* sets the height at which the sheet tray 36 is detected by the second tray detector 58, as the sheet-mounting preparation position. Thus, if the sheet tray 36 holds large-size sheets, the sheet-tray control unit 35*b* moves up the sheet tray 36 between the highest position (to which the sheet tray 36 is lifted from the position where the upper-surface detector 39 detects the uppermost sheet on the sheet tray 36) and the lowest position where the second tray detector 58 detects the sheet tray 36. Further, in order to mount large-size sheets on the sheet tray 36, the sheet-tray control unit 35*b* moves the sheet tray 36 to the lowest possible position as shown in FIG. 13, where the sheet tray 36 is detected by the second tray detector 58.

Since a large-size sheet is larger and heavier than a small-size sheet, the lift motor M1 of the lift mechanism 40 must generate a larger output if the sheet tray 36 holds large-size sheets as compared with the case where the sheet tray 36 holds small-size sheets in the same number. In the sheet feeding apparatus 5' according to the second embodiment, however, the sheet tray 36 is lowered to a sheet-mounting preparation position at height h1, as shown in FIG. 12, in order to hold small-sized sheets. On the other hand, in order to hold large-size sheets, each heavier than a small-size sheet, the sheet tray 36 is lowered, as shown in FIG. 13, to a sheet-mounting preparation position at height h2 smaller than height h1. The lowest possible position of the sheet tray 36 is set in a similar way. The number in which large-size sheets can be mounted on the sheet tray 36 is thus smaller than the number in which the small-size sheets can be mounted on the sheet tray 36. That is, large-size sheets are mounted on the sheet tray 36 in smaller number than the small-size sheets. Hence, the lift motor M1 can be used to lift large-size sheets, as in lifting small-size sheets.

In the sheet feeding apparatus 5' according to the second embodiment, the sheets are classified from the size data acquired by the sheet-data acquiring unit 35*a*. Nonetheless, the sheets may be classified from other data, for example, the weight of each sheet or any other index such as material or length thereof. In this case, the sheet-data acquiring unit 35*a* may acquire sheet-type data classified by any of the foregoing indices, and the sheet-mounting preparation position or the lowest possible position of the sheet tray 36 may then be set based on the sheet-type data acquired. Further, in the sheet feeding apparatus 5' according to the second embodiment (shown in the drawings), two tray detectors 57 and 58 for detecting that the sheet tray 36 has reached the storage box 33 are located at different positions. Instead, three or more tray detectors may be provided at three or more different positions, respectively, so that three or more sheet-mounting preparation positions or three or more lowest sheet-tray positions can set according to the sheet type.

The sequence of feeding sheets in the sheet feeding apparatus 5' according to the second embodiment is similar to the sequence performed in the sheet feeding apparatus 5 according to the first embodiment, and will not be explained here.

Figure 14:
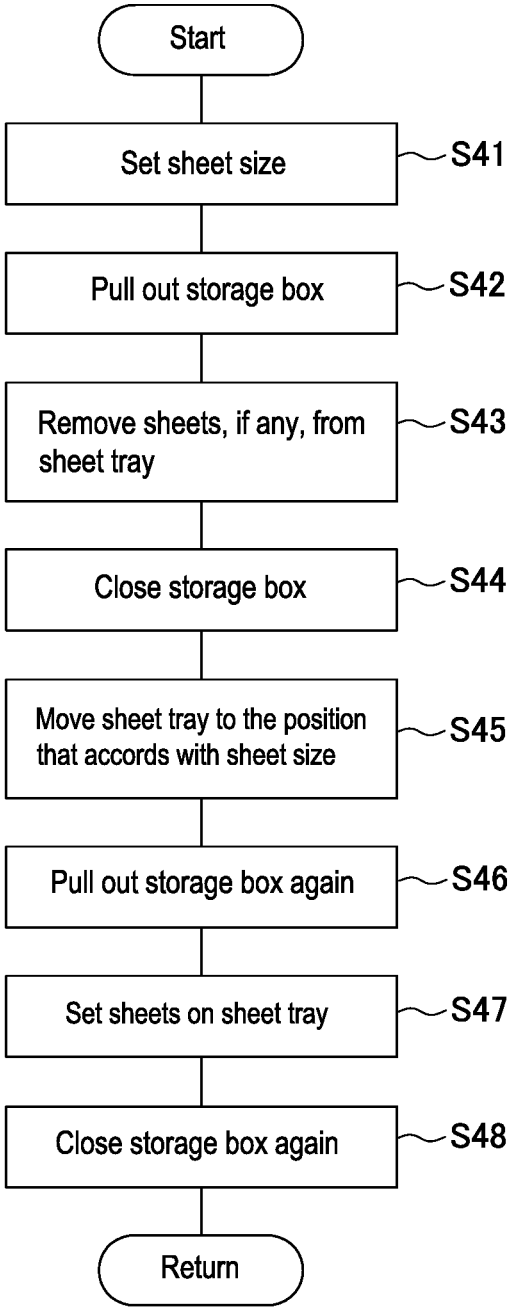
FIG. 14 is a flowchart showing the sequence of placing sheets in the sheet feeding apparatus according to the second embodiment of this invention.

The sequence of changing the type of sheets in the sheet feeding apparatus 5' according to the second embodiment will now be explained with reference to FIG. 14.

First, the type of sheets is set at the control panel 25 in accordance with size or material of the sheets to feed (more precisely, the size, in this instance) (Step S41). Then, the sheet-data acquiring unit 35*a* of the control device 35 acquires the data representing the type of the sheets. The operator then pulls the storage box 33 from the housing 31, at the front thereof, as viewed in FIG. 11 (Step S42). The operator then removes sheets, if any, from the sheet tray 36 (Step S43). If the unlock button 44*b* is pushed before the storage box 33 is pulled out, the sheet tray 36 is moved to the sheet-mounting preparation position that accords with the type of sheets and set before the sheet size is set. In the sheet feeding apparatus 5' (shown in FIG. 11) according to the second embodiment, the detection selecting unit 35*f* selects the first tray detector 57 if the sheet type set before changing the sheet size is small-size sheet. Then, the sheet tray 36 is moved to the lowest possible position shown in FIG. 12, where the first tray detector 57 detects the sheet tray 36. If the sheet type set before changing the sheet size is large size sheet, the detection selecting unit 35*f* selects the second tray detector 58. Then, the sheet tray 36 is moved to the lowest possible position (shown in FIG. 13), where the sheet tray 36 is detected by the second tray detector 58.

When the sheet tray 36 is emptied, holding no sheets, the storage box 33 is closed and then inserted into the housing 31 (Step S44). Once the storage box 33 is closed, the sheet detector 56 detects that no sheets are mounted on the sheet tray 36. Then, the height setting unit 35*c* sets the sheet-mounting preparation position for the sheets, on the basis of the sheet-type data acquired by the sheet-data acquiring unit 35*a*, and the lowest-position setting unit 35*d* sets the height for the sheet type, as the lowest possible position for the sheets. In the sheet feeding apparatus 5' according to the second embodiment, in order to feed small-size sheets, the detection selecting unit 35*f* selects the first tray detector 57; the lowest-position setting unit 35*d* sets the height position (lowest position) of the sheet tray 36, detected by the first tray detector 57; and the height setting unit 35*c* sets, as sheet-mounting preparation position, the height position of the sheet tray 36, detected by the first tray detector 57. If the sheets on the sheet tray 36 are large-size sheets, the detection selecting unit 35*f* selects the second tray detector 58; the lowest-position setting unit 35*d* sets, as the lowest possible position, the height position of the sheet tray 36, which the second tray detector 58 has detected; and the height setting unit 35*c* sets, as sheet-mounting preparation position, the height position of the sheet tray 36, detected by the second tray detector 58. As a result, in accordance with the type of the sheets, the sheet-tray control unit 35*b* moves up or down the sheet tray 36 to the sheet-mounting preparation position set by the height setting unit 35*c* (Step S45).

After the sheet tray 36 is moved to the sheet-mounting preparation position, the storage box 33 is pulled from the housing 31 of the sheet feeding apparatus 5' (Step S46). Sheets of the type set in Step S41 are then placed in the sheet tray 36 and are then set at a prescribed position in the sheet tray 36 (Step S47). Then, the storage box 33 is closed and inserted into the housing 31 (Step S48). The sheet-side adjusting members (now shown) and the sheet rear-end adjusting member 42 are moved to prescribed positions, abutting on the lateral edges of any sheet and rear end of any sheet mounted on the sheet tray 36, arranging the sheets at the prescribed position in the sheet tray 36.

When the storage box 33 is inserted into the housing 31 and closed, the sheet-tray control unit 35*b* sets the upper surface of the uppermost sheet placed at the sheet feeding position in the sheet tray 36, in the same way as in the first embodiment (see Steps S17 to S20 shown in FIG. 8). Thus, the sheets can now be fed to the image forming apparatus 2.

With reference to the drawings, the sheet feeding apparatuses 5 and 5' according to this invention and an image forming system 1 having the sheet feeding apparatus 5 or 5' have been described above. The present invention is not limited to the embodiments described above, nevertheless. In the first embodiment, for example, the housing 31 is composed of a main part 31*a* and an extending part 31*b*, which are formed integral. Instead, the main part 31*a* and the extending part 31*b* may be formed as parts and may be connected to provide a housing 31. In the second embodiment, the sheet size is set before the storage box 33 is pulled from the housing 31 to change the sheet type, and in order to pull the storage box 33 out, the sheet tray 36 is moved to the sheet-mounting preparation position that accords with the type of the sheets mounted on the sheet tray 36. Alternatively, the sheet size may be set after the storage box 33 is pulled out and before the storage box 33 is closed after the sheets on the sheet tray 36 have been removed from it. Further, to pull the storage box 33 for the first time after the sheet type is changed, the sheet tray 36 may be moved to the sheet-mounting preparation position that accords with the sheet size changed. In this case, the sheets may be removed from the sheet tray 36 and the sheets of the type changed may then be mounted on the sheet tray 36. Still further, in the second embodiment, the height position set by the height setting unit 35*c* and the lowest possible position set by the lowest-position setting unit 35*d* are changed in accordance with the sheet size, but they may be changed in accordance with the sheet length measured in the sheet-feeding direction.

In the embodiments shown in the drawings, the sheet feeding apparatus 5 (or 5') described above is arranged next to an image forming apparatus 2. Instead, the sheet feeding apparatus 5 (or 5') can be incorporated in the image forming apparatus 2, like the sheet cassettes 7*a* and cassette 7*b*. The control device 35 that controls some other components of the sheet feeding apparatus, including the sheet tray 36 and the sheet separating/feeding mechanism 34, may be arranged either inside or outside the housing 31 of the sheet feeding apparatus 5 (or 5'). In the embodiments described above, the control device 35 is provided in the sheet feeding apparatus 5. Instead, the control device 35 can be arranged in another apparatus, e.g., the image forming apparatus 2. In this case, the control device 35 can control the actuator of the lift motor M1 from the image forming apparatus. Further, the control device 35 may be provided as a component independent of the sheet feeding apparatus 5 (or 5') and the image forming apparatus 2.

This application is based upon, and claims the benefit of priority from, the prior Japanese Patent Applications No. 2017-053025, filed on Mar. 17, 2017, the entire contents of which are incorporated herein by reference.

What is claimed is:

1. A sheet feeding apparatus for feeding sheets comprising:

a housing;

a storage box arranged in the housing and being able to be pulled from the housing;

a sheet tray arranged in the storage box and configured to hold sheets;

a sheet feeding unit configured to feed sheets from the sheet tray;

a lift unit configured to move the sheet tray up and down;

a controller, as a sheet data acquiring unit for acquiring a sheet type, including an input device having a sensor or an operator input panel for determining the sheet type;

a detecting unit configured to detect opened or closed state of the storage box, wherein when the sheet type to be held on the sheet tray is changed to another type, if the detecting unit detects that the storage box in the opened state has been changed to the closed state, the lift unit moves the sheet tray up or down to a sheet holding position set for the another type of sheets.

2. The sheet feeding apparatus according to claim 1, wherein the sheet type includes a length measured in a sheet-feeding direction; and the lift unit moves the sheet tray down to a first sheet-holding position if the sheets held on the sheet tray have a first length, and moves the sheet tray up to a second sheet-holding position higher than the first sheet-holding position if the sheets held on the sheet tray have a second length greater than the first length.

3. The sheet feeding apparatus according to claim 1, wherein the sheet type includes a sheet size; and the lift unit moves the sheet tray down to a first sheet-holding position if the sheets held on the sheet tray have a first size, and moves the tray up to a second sheet-holding position higher than the first sheet-holding position if the sheets held on the sheet tray have a second size greater than the first size.

4. The sheet feeding apparatus according to claim 1, wherein the sheet type includes a sheet weight; and the lift unit moves the sheet tray down to a first sheet-holding position if the sheets held on the sheet tray have a first weight, and moves the sheet tray up to a second sheet-holding position higher than the first sheet-holding position if the sheets held on the tray have a second weight greater than the first weight.

5. The sheet feeding apparatus according to claim 1, further comprising a sheet detecting unit configured to detect whether the sheet tray holds sheets, and in which if the sheet detecting unit detects that the sheet tray holds no sheets, the lift unit moves the sheet tray up or down to the sheet holding position set.

6. The sheet feeding apparatus according to claim 1, wherein the sheet tray includes an extending part configured to support an end part of any sheet held on the sheet tray, which is rear in a sheet-feeding direction.

7. A sheet feeding apparatus for feeding sheets comprising:

a sheet tray configured to hold sheets;

a sheet feeding unit configured to feed sheets from the sheet tray;

a lift unit configured to move the sheet tray up and down;

a controller, as a sheet data acquiring unit for acquiring a sheet type, including an input device having a sensor or an operator input panel for determining the sheet type;

a sheet-holding position setting unit configured to set, when changing a sheet type disposed on the sheet tray, based on the sheet type to be changed, a sheet holding position at which the sheet tray should hold sheets; and a sheet detecting unit configured to detect whether the sheet tray holds sheets, wherein if the sheet detecting unit detects no sheets on the sheet tray, the lift unit moves the sheet tray up or down to the sheet holding position set by the sheet-holding position setting unit.

8. The sheet feeding apparatus according to claim 7, wherein the sheet type includes a sheet weight; and the sheet-holding position setting unit sets a first sheet-holding position if the sheet weight acquired by a sheet-data acquiring unit is first weight, and sets a second sheet-holding position higher than the first sheet-holding position if the sheet weight acquired is a second weight greater than the first weight.

9. The sheet feeding apparatus according to claim 7, wherein the sheet type includes a sheet size; and the sheet-holding position setting unit sets a first sheet-holding position if data acquired by s sheet-data acquiring unit represents a first sheet size, and sets a second sheet-holding position above the first sheet-holding position if the data acquired represents a second sheet size greater than the first sheet size.

10. The sheet feeding apparatus according to claim 7, wherein the sheet type includes a sheet length measured in a sheet-feeding direction; and the sheet-holding position setting unit sets a first sheet-holding position if a sheet length measured in the sheet-feeding direction and acquired by a sheet-data acquiring unit is equal to or shorter than a first length, and sets a second sheet-holding position above the first sheet-holding position if the sheet length measured is longer than the first length.

11. The sheet feeding apparatus according to claim 7, further comprising:

a housing;

a storage box incorporating the sheet tray, arranged in the housing and being able to be pulled from the housing; and a detecting unit configured to detect opened and closed states of the storage box, wherein when the detecting unit detects that the storage box has been inserted into the housing and the detection unit detects the closed state, the lift unit moves the sheet tray up or down to the sheet holding position set by sheet-holding position setting unit.

12. The sheet feeding apparatus according to claim 7, further comprising:

a storage box configured to hold the sheet tray, and an extending part having an auxiliary tray configured to support an end part of a sheet held on the sheet tray, which is rear in a sheet-feeding direction.

13. The sheet feeding apparatus according to claim 12, wherein the lift unit has a lift motor configured to move the sheet tray and the auxiliary tray up and down.

14. An image forming system configured to form images on sheets, comprising:

a housing;

a storage box provided in the housing and being able to be pulled from the housing;

a sheet tray provided in the storage box;

a sheet feeding unit configured to feed sheets from the sheet tray;

an image forming unit configured to form an image on a sheet fed;

a lift unit configured to move the sheet tray up and down;

a sheet-data acquiring unit configured to acquire sheet type data which will be updated to change a type of sheets to be mounted on the sheet tray, the sheet-data acquiring unit including an input device having a sensor or an operator input panel for determining the sheet type;

a sheet-holding position setting unit configured to set a sheet-holding position at which the sheet tray should hold sheets, on a basis of the sheet type data acquired by the sheet-data acquiring unit;

a control unit configured to control the lift unit, causing the same to move the sheet tray up or down to the sheet holding position set by the sheet-holding position setting unit, and a detecting unit configured to detect whether the storage box is in an opened or closed state, wherein when the detecting unit detects the closed state, the control unit controls the lift unit, moving the sheet tray up or down to the sheet-holding position set by the sheet-holding position setting unit.

15. The image forming system according to claim 14, further comprising:

an extending part having an auxiliary tray configured to support an end part of a sheet held on the sheet tray, which is rear in a sheet-feeding direction.

16. The image forming system according to claim 14, further comprising a sheet detecting unit configured to detect whether the sheet tray holds sheets, and in which the control unit controls the lift unit, moving the sheet tray up or down to the sheet-holding position set by the sheet-holding position setting unit, if the sheet detecting unit detects no sheets on the sheet tray.

17. The image forming system according to claim 14, wherein the sheet type data includes a sheet size; and the sheet-holding position setting unit sets a first sheet-holding position if the data acquired by the sheet-data acquiring unit represents a first sheet size, and sets a second sheet-holding position above the first sheet-holding position if the data acquired represents a second sheet size greater than the first sheet size.

18. The image forming system according to claim 14, wherein the sheet type data includes a sheet length measured in the sheet-feeding direction; and the sheet-holding position setting unit sets a first sheet-holding position if the sheet length measured in the sheet-feeding direction and acquired by the sheet-data acquiring unit is equal to or shorter than a first length, and sets a second sheet-holding position above the first sheet-holding position if the sheet length measured is longer than the first length.

19. The image forming system according to claim 14, wherein the sheet type data includes a sheet weight; and the sheet-holding position setting unit sets a first sheet-holding position if the sheet weight acquired by the sheet-data acquiring unit is first weight, and sets a second sheet-holding position higher than the first sheet-holding position if the sheet weight acquired is a second weight greater than the first weight.

* * * * *